US007393068B2

(12) United States Patent
Sato et al.

(10) Patent No.: US 7,393,068 B2
(45) **Date of Patent: *Jul. 1, 2008**

(54) SLIDING ASSISTING APPARATUS

(75) Inventors: Hiroji Sato, Tokyo (JP); Yasutomo Kobayashi, Yamato (JP); Takefumi Tsuchiya, Zushi (JP)

(73) Assignee: Nifco Inc., Yokohama-Shi (JP)

( * ) Notice: Subject to any disclaimer, the term of this patent is extended or adjusted under 35 U.S.C. 154(b) by 423 days.

This patent is subject to a terminal disclaimer.

(21) Appl. No.: 11/177,353

(22) Filed: Jul. 11, 2005

(65) Prior Publication Data

US 2006/0016279 A1 Jan. 26, 2006

(30) Foreign Application Priority Data

Jul. 21, 2004 (JP) ..... 2004-213627

(51) Int. Cl.
*A47B 88/00* (2006.01)

(52) U.S. Cl. ..... 312/333

(58) Field of Classification Search ..... 312/333, 312/334.46, 334.27, 319.1, 334.1, 334.7, 312/334.44; 384/21, 19
See application file for complete search history.

(56) References Cited

U.S. PATENT DOCUMENTS

| | | | | |
|---|---|---|---|---|
| 345,227 | A * | 7/1886 | Fraser | 312/334.32 |
| 6,039,421 | A * | 3/2000 | Fulterer | 312/333 |
| 6,398,327 | B1 * | 6/2002 | Momoze | 312/319.1 |
| 6,848,759 | B2 * | 2/2005 | Doornbos et al. | 312/319.1 |
| 7,028,370 | B2 * | 4/2006 | Hoshide et al. | 16/96 R |
| 7,185,959 | B2 * | 3/2007 | Mueller et al. | 312/331 |
| 7,240,978 | B2 * | 7/2007 | Kobayashi et al. | 312/333 |
| 7,281,773 | B2 * | 10/2007 | Sato et al. | 312/333 |
| 2002/0096405 | A1 * | 7/2002 | Gasser | 188/82.1 |
| 2003/0067257 | A1 * | 4/2003 | Gasser | 312/331 |
| 2005/0218759 | A1 * | 10/2005 | Kobayashi et al. | 312/331 |
| 2006/0017359 | A1 * | 1/2006 | Sato et al. | 312/333 |
| 2007/0114896 | A1 * | 5/2007 | Orita | |

FOREIGN PATENT DOCUMENTS

| | | | |
|---|---|---|---|
| EP | 1188397 | A1 | 3/2002 |
| EP | 1350443 | A1 | 10/2003 |
| GB | 1500767 | A | 6/1975 |
| JP | 02-286102 | | 11/1990 |

* cited by examiner

*Primary Examiner*—Janet M Wilkens
(74) *Attorney, Agent, or Firm*—Manabu Kanesaka

(57) ABSTRACT

A sliding assisting apparatus includes a main body provided on a base or a movable body, and having a pair of sliders disposed in a case; lock members formed on the sliders; coupling parts provided on the case to couple/uncouple with the lock members; a forcing device provided between the two sliders to accumulate a biasing force when one of the sliders is slid to move away from the other; a pair of strikers provided on the base or the movable body; and a switch between a case restrained position and a case restraint released position. One striker is disposed between the first and second sliding positions to cause the movable body to slide toward the first sliding position, and a second striker is disposed closer to the second sliding position than the first striker to cause the movable body to slide toward the second sliding position.

12 Claims, 14 Drawing Sheets

2 (20)
3 (31)
4 (41)
5
6
6a
6b
10
13
13a
13b
15
18
18a
18b
22
23
24
25
27
30
32
37
38
40
43
48

Fig. 10(a)
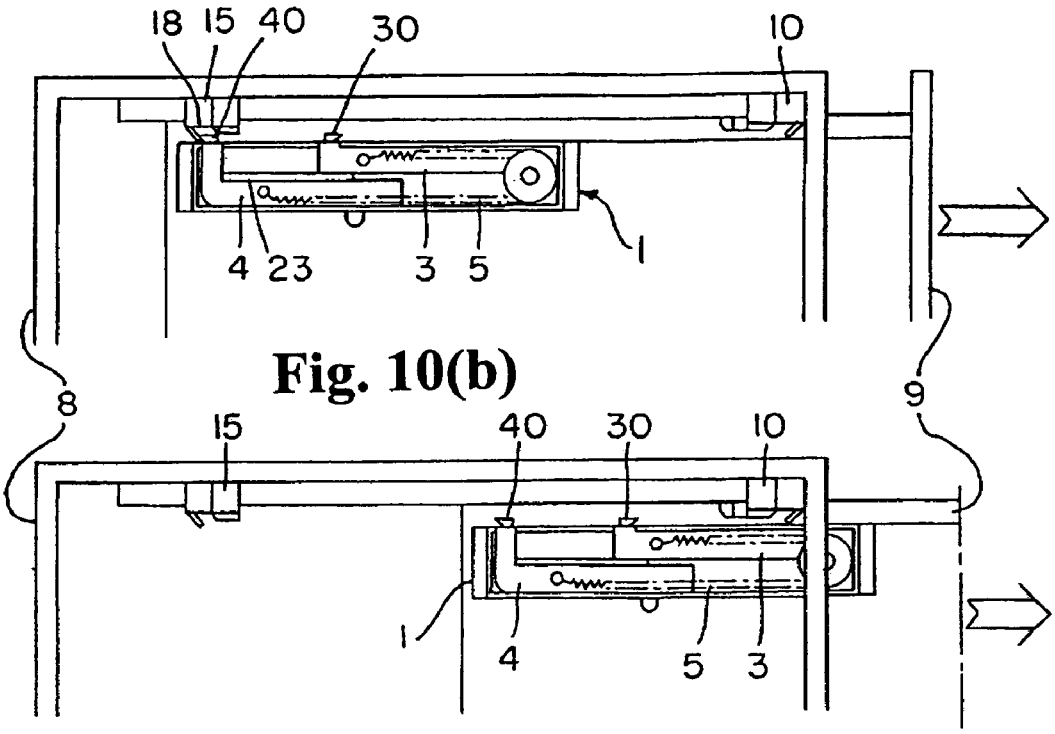
Fig. 10(b)
Fig. 10(c)
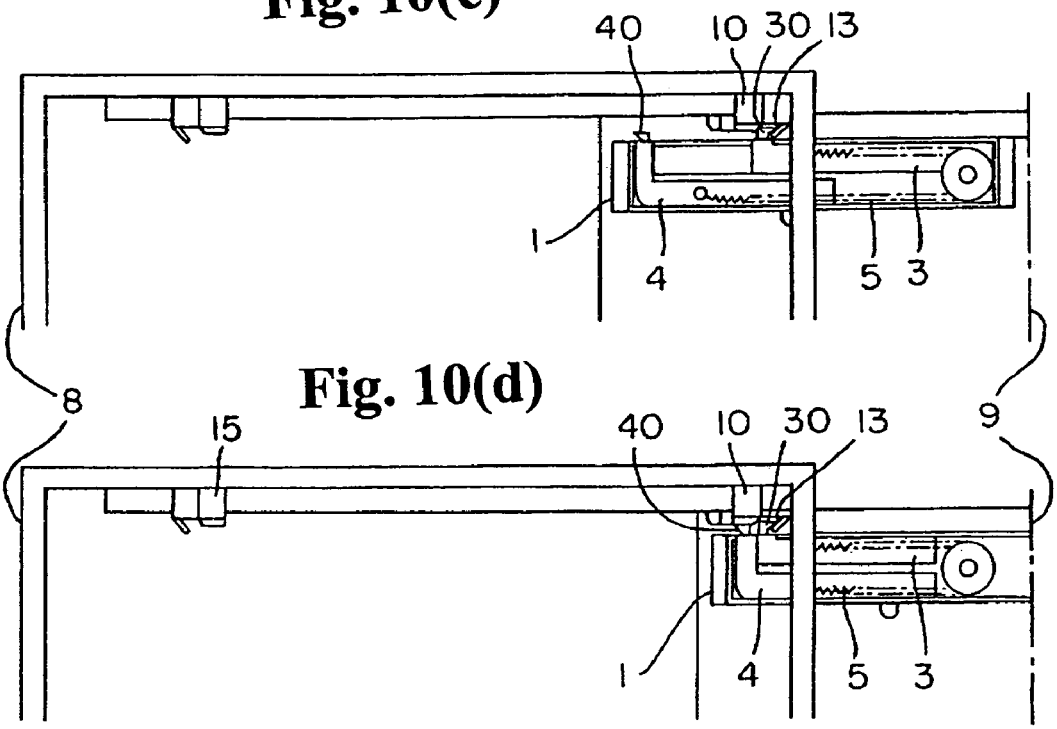
Fig. 10(d)

SLIDING ASSISTING APPARATUS

BACKGROUND OF THE INVENTION AND RELATED ART STATEMENT

The present invention relates to a sliding assisting apparatus for assisting the sliding of a movable body such as a drawer or a lid body between a first and second positions on a base.

In a structure in which a movable body is induced to slide with respect to a base or housing member, between a stored or retracted position (hereinafter drawn-in position) and a drawn-out position (wherein the movable body is moved to an extended or open position wherein it extends away from the base), because it is tiresome and lacks a feeling of high quality if all the switching operations, are performed manually, it has been proposed that the movable body is driven in either direction of the drawn-out position or the drawn-in position and is slid automatically in that direction.

FIGS. 14(*a*) and 14(*b*) show an apparatus for motivating a drawer which is disclosed the publication of Japanese Examined Patent Publication No. H5-023763. FIG. 14(*a*) shows a state of moving from a drawn-in position of the movable body (not illustrated), and FIG. 14(*b*) shows a drawn-out position. Numeral 50 denotes a side wall of the base, numeral 55 is a drive pin on the side of the movable body, numeral 60 denotes a tilting part placed between the base side wall and the movable body, and numeral 65 designates a spring member. A guide track 51 is provided on the base side wall 50. This guide track 51 includes a straight part 51*a* which extends horizontally in a fore-and-aft direction or front-to-back direction (as it will be referred to hereinafter) in which the drawer is movable, and a bow-shaped part 51*b* on the front side (right side as seen in the drawing).

A tilting part 60 has a slot 61 which is opened at the top, and a diagonal side wall 62 which extends from the front side of the slot 61, and bolts 63, 63 are coupled in the guide track 51. The spring member 65 accumulates force in the course of sliding of the movable body from the inserted or "drawn-in" position to the retracted or "drawn-out" position, in a state in which one end is fixed on the side of the base and the other end is fixed on the tilting part 60. Also, in this structure, the movable body is built into the side of the base in a manner wherein the drive pin 55 is coupled in the slot 61.

When the movable body is manually drawn from the drawn-in position to the drawn-out position, the tilting part 60 is moved along the straight part 51*a* of the guide track 51 until it reaches the bow-shaped part 51*b*. At this time, the drive pin 55 moves out of the slot 61 and engages the diagonal side wall 62. In accordance with this operation, the movable body is checked or locked in the drawn-out position in opposition to the force of the now extended spring member 65. Upon being pushed backward it is drawn in by the force (tension) accumulated in the spring member 65 after the drive pin 55 is returned from the diagonal wall part 62 into the slot 61.

In the above-mentioned conventional structure, for example, although the movable body is slid automatically almost entirely from the drawn-out position to the drawn-in position, a strong pulling operation force by that amount becomes necessary when going from the drawn-in position to the drawn-out position, and the convenience of use becomes poor. Also, because the drive pin 55 is arranged to escape from the slot 61 by the forward tilting of the tilting member 60 and is coupled with the diagonal side wall 62 as a lock mechanism for locking the movable body in opposition to the force of the spring member 65, the coupling force is weak and there is a problem that the lock may be accidentally released due to vibrations, and the like.

Moreover, in the conventional structure, once the movable body is removed from the base, because it is drawn into the base by the force of the spring member 65 in a state having the slot 61 turned upward as shown in FIG. 14(*a*) by releasing of the tilting part 60 from the drive pin 55, it is difficult to assemble the movable body again on the base, and the drive pin 55, and the like, are easily damaged when the movable body is forcefully pushed in toward the side of the base. Also, in this conventional structure, the operational characteristics are limited in that it does not have functions for assisting both operations of the case when sliding the movable body in the direction of the drawn-in position and the case when sliding it in the direction of the drawn-out position.

An object of the present invention is to eliminate problems such as those described above, for example, and is directed to improving the convenience of use and feeling of high quality of the apparatus to which it is applied using a comparatively simple structure.

Further objects and advantages of the Invention are apparent from the following description of the invention.

SUMMARY OF THE INVENTION

In order to achieve the above purpose, the present invention resides in a sliding assisting apparatus for assisting an operation of sliding a movable body on a base in one direction (for example drawing-in operation) from one sliding position (for example drawn-out position) to another sliding position (for example drawn-in position), and an operation of sliding it in another direction (for example drawing-out operation) from the other sliding position (for example drawn-in position) to the one sliding position (for example drawn-out position). An embodiment of the invention comprises: a main body, which is provided on one of the base and the movable body, and has a pair of sliders which is disposed inside a case of the main body and are arranged to be slidable in the same direction as the movable body.

This embodiment further comprises lock members which are respectively supported on and capable of moving with respect to each of the sliders. The lock members have front ends protruding out of the case. In addition, coupling parts are provided on the case and couple/uncouple with the lock members of the respective sliders. A forcing means is operatively disposed between the two sliders and is arranged to accumulate a biasing force when one of the sliders is slid with respect to the case away from the other. A pair of strikers, is provided on the other of the base and the movable body, and switch between a case restrained position in which the lock members of the sliders are locked by the coupling parts to restrain the concerned slider to the case, and a case restraint released position in which the locking is released to enable sliding of the concerned sliders on the case.

In this embodiment, a first striker of the pair of strikers is disposed between the one sliding position (for example drawn-out position) and the other sliding position (for example drawn-in position), and causes the movable body to slide toward one sliding position (for example drawn-out position), while the other striker is disposed in a position more toward the other sliding position (for example drawn-in position) compared with the first striker, and causes the movable body to slide toward the other sliding position (for example drawn-in position).

BRIEF DESCRIPTION OF THE DRAWINGS

FIGS. 10(*a*), 10(*b*), 10(*c*) and 10(*d*) depict operations which occur during a drawing-out operation of the above sliding assisting apparatus.

DETAILED DESCRIPTION OF THE PREFERRED EMBODIMENTS

Figure 1:
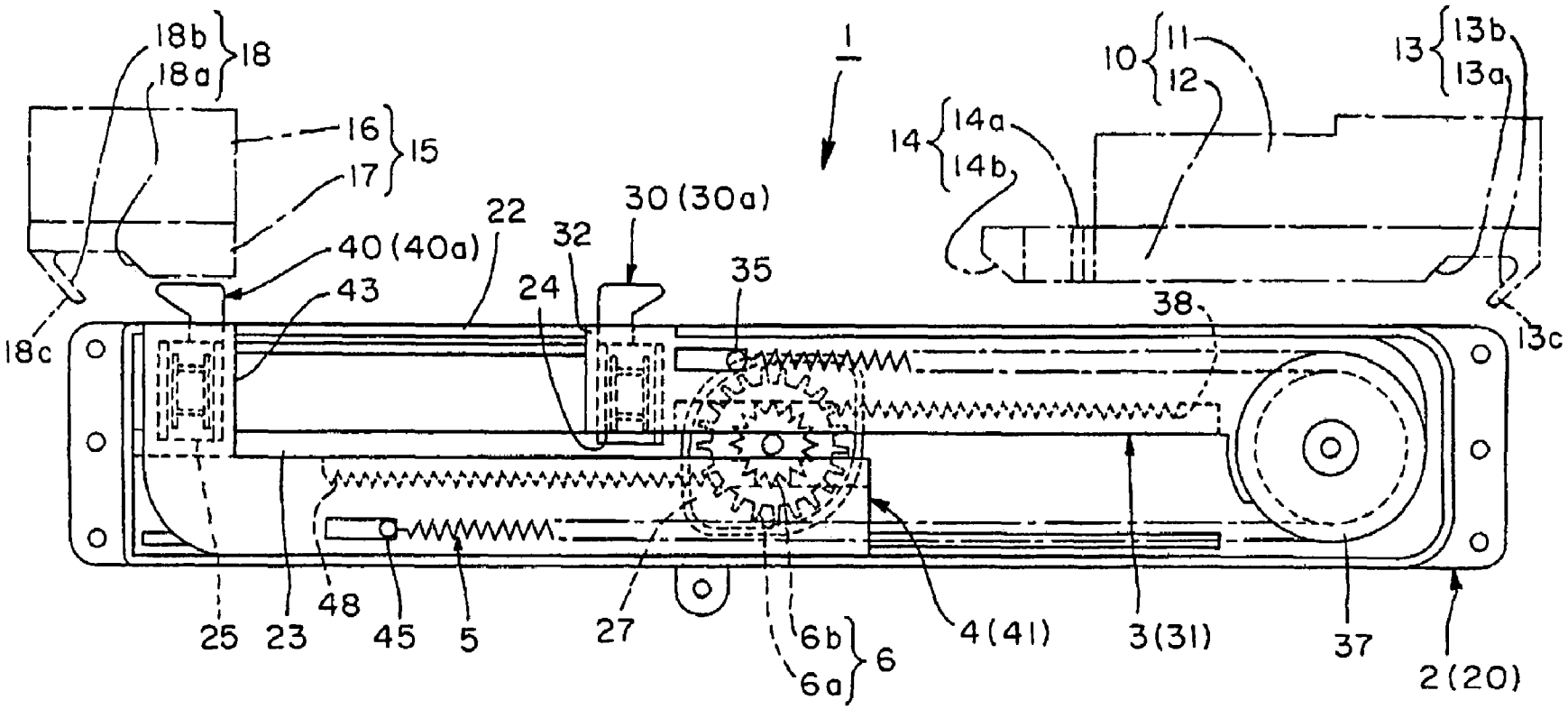
FIG. 1 is an exemplary drawing showing the operational characteristics (force accumulating state) of an embodiment of the present invention.

An apparatus according to the present invention is made such that when the movable body is slid toward one sliding position (for example drawn-out position) up to a mid-course position from the other sliding position (for example drawn-in position), and when the movable body is slid toward the other sliding position (for example drawn-in position) up to a mid-course position from the one sliding position (for example drawn-out position), by switching of the corresponding slider (that is, this slider is in the case restraint released position, and the other slider is in the case restrained position) from the case restraint released position to the case restrained position by means of the striker (the forcing means accumulates force in this process), the force accumulated in the forcing means up to then is held, and in addition, by switching of the corresponding slider from the case restrained position to the case restraint released position, the movable body is slid from the mid-course position to the one sliding position (for example drawn-out position) or the other sliding position (for example drawn-in position) by the force accumulated in the forcing means.

In other words, a feature of the structure of the embodiment of present invention resides in that the main body is provided on one of the base and the movable body, and is such that the strikers which move the lock members toward a direction roughly orthogonal to the sliding direction of the movable body to couple/uncouple with the coupling part, are provided on the other of the base and the movable body. When the two sliders are in the case restrained position and the case restraint released position, the force of the forcing means is released or it becomes capable of accumulating force, and when the two sliders are in the case restrained position, the force accumulated in the forcing means is held or maintained in a stored condition.

In the present specification, "case restrained position," referring to the drawings, should be taken to mean that the corresponding slider 3 or 4 is integrally linked to the case 2 and is rendered incapable of sliding independently. (This can also be taken as locked position, in which the slider 3 or 4 is integrally linked or operationally linked with the movable body 9.) As opposed to this, "case restraint released position," referring to the drawings, should be taken to mean that the corresponding slider 3 or 4 becomes unlinked from the case 2 and becomes capable of sliding independently. This can also be taken as unlocked position, in which the slider 3 or 4 is unlinked with the movable body 9 or the operational linkage is released.

Each lock member and each striker of the present invention (constituted by different elements in the different embodiments) can be configured respectively to have the same shape, thus making it possible to reduce manufacturing cost, and the like, by making the main members dual-use.

The sliding assisting apparatus of the present invention has advantages such as the following.

In accordance with one embodiment of the invention, via the use of the main body and the strikers, it is possible to slide respectively to the final one sliding position (for example drawn-out position) and the final other sliding position (for example drawn-in position) automatically using the force of the forcing means, in the process of switching the movable body from the other sliding position (for example drawn-in position) to the one sliding position (for example drawn-out position), and in the process of switching the movable body from the one sliding position (for example drawn-out position) to the other sliding position (for example drawn-in position), that is, from each mid-course position, and from that viewpoint the convenience of use can be improved.

More specifically, because both assisting functions of sliding operations in both directions (drawing-in operation and drawing-out operation) can be achieved by a single unit construction, it becomes advantageous such that it has excellent building-in characteristics and maintenance characteristics, and it tends not to be limited in setup space.

Figures 2A, 2B:
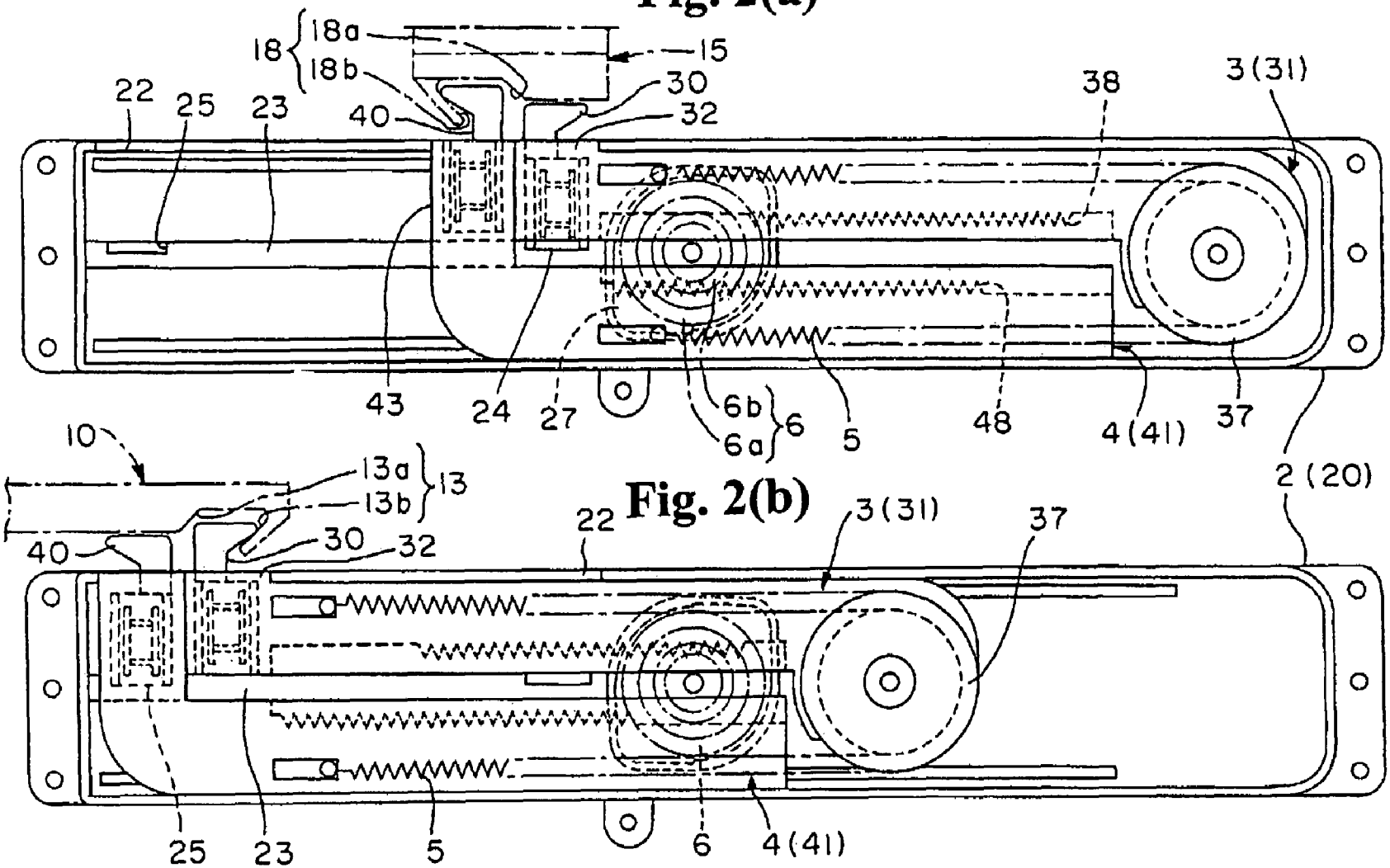
FIGS. 2(*a*) and 2(*b*) are exemplary drawings showing the operational characteristics (force releasing state) of an embodiment of the present invention.
Figure 3:
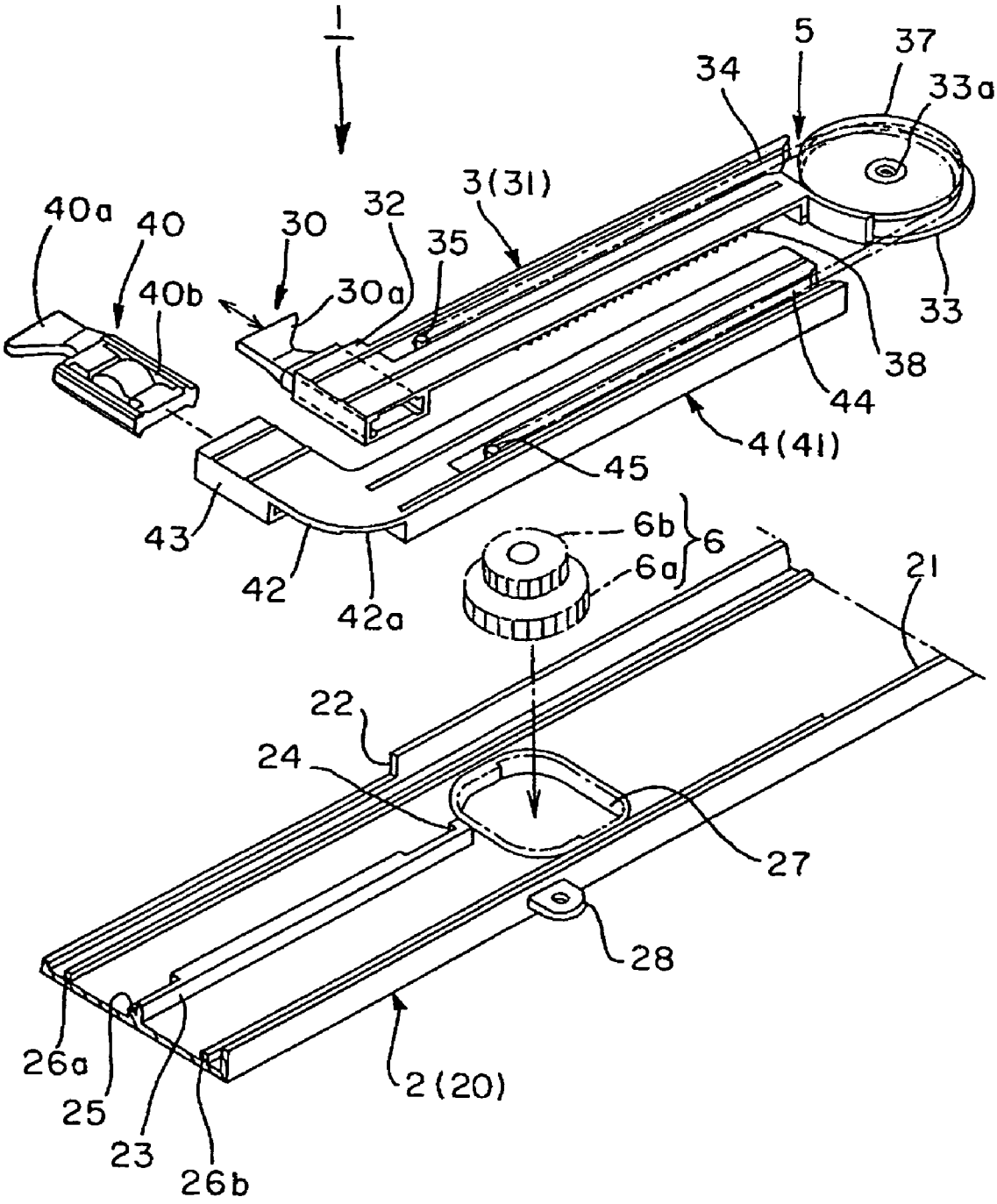
FIG. 3 is an exploded perspective view showing the relationships among the main members of the sliding assisting apparatus shown in FIG. 1.
Figure 4A:
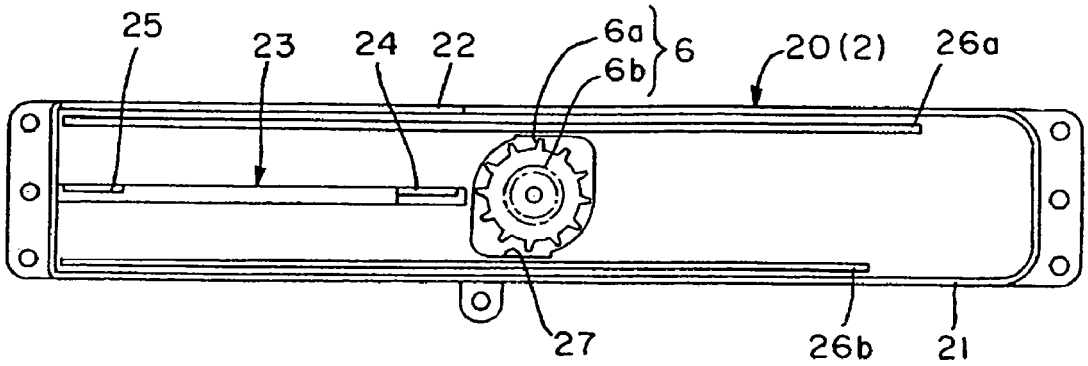
FIGS. 4(*a*) and 4(*b*) are respectively plan and elevational views showing the base of the case constituting the above sliding assisting apparatus.
Figure 4B:
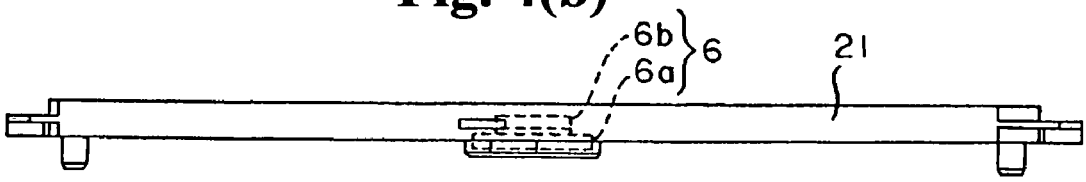
Figure 5:
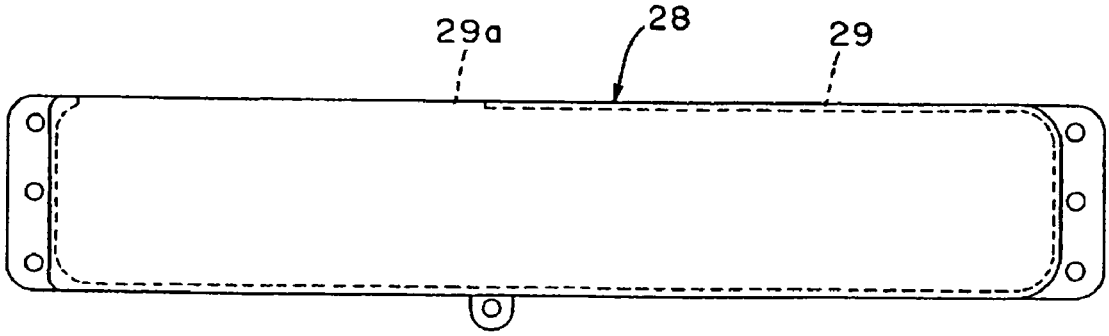
FIG. 5 is a drawing showing the cover of the case shown in FIGS. 4(*a*) and 4(*b*).

A preferred embodiment of the present invention is explained with reference to the drawings. FIG. 1 and FIGS. 2(*a*) and 2(*b*) typically show the operation of the apparatus of the embodiment of the present invention. FIG. 1 shows the state in which force is accumulated while FIGS. 2(*a*) and 2(*b*) show the state in which the force is released. FIG. 3 is an exploded view showing the relationships between the main members constituting the apparatus. FIGS. 4(*a*) and 4(*b*) are a top view and a side views showing the case main body of the apparatus together with the damper, and FIG. 5 is a top view showing the cover attached to the case main body.

Figure 6A:
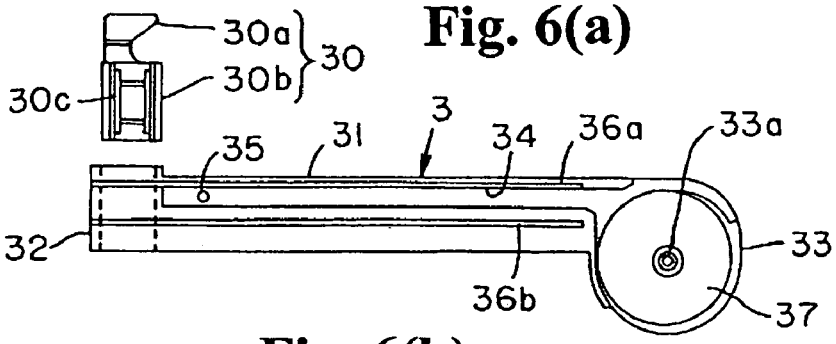
FIGS. 6(*a*), 6(*b*) and 6(*c*) are drawings showing features of one of the sliders which constitute the above sliding assisting apparatus.
Figure 6B:
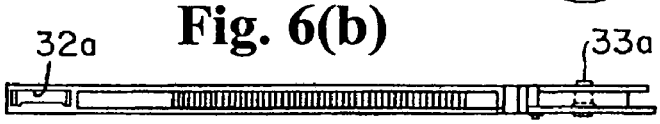
Figure 6C:
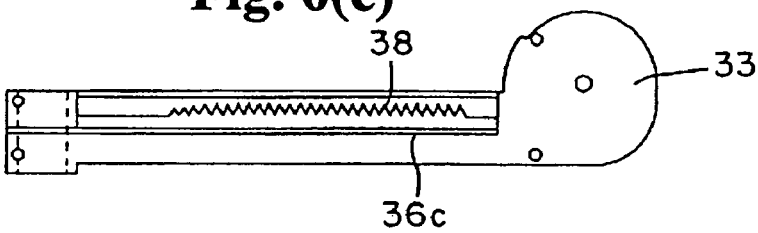
Figure 7A:
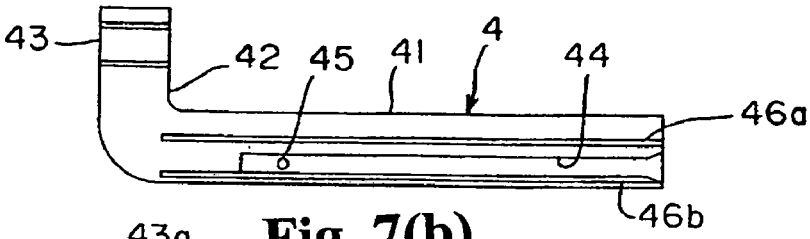
FIGS. 7(*a*), 7(*b*) and 7(*c*) are drawings showing features of the other slider which constitutes the above sliding assisting apparatus.
Figure 7B:
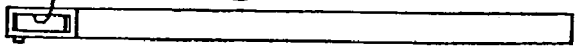
Figure 7C:
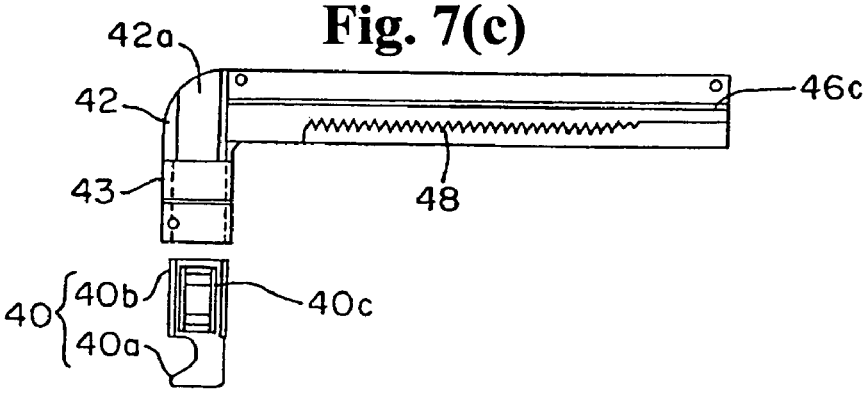

FIGS. 6(*a*)-6(*c*) are views of one of the sliders constituting the apparatus, wherein FIG. 6(*a*) is a top view showing it together with the lock member, FIG. 6(*b*) is a side view, and FIG. 6(*c*) is a bottom view. FIGS. 7(*a*)-7(*c*) show the other slider wherein FIG. 7(*a*) is a top view, FIG. 7(*b*) is a side view, and FIG. 7(*c*) is a bottom view showing it together with the lock member.

Figure 8A:
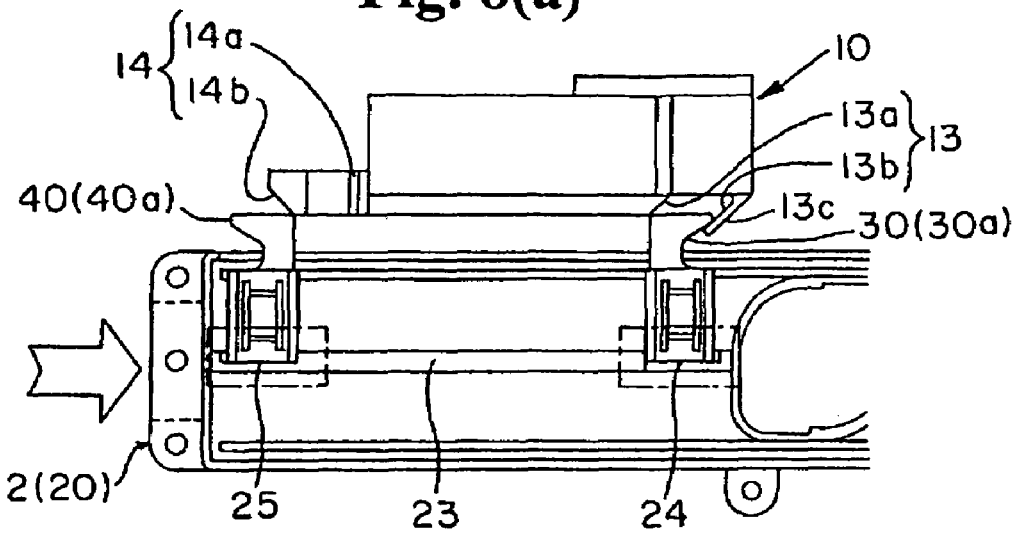
FIGS. 8(*a*), 8(*b*) and 8(*c*) are exemplary drawings showing operations which occur when releasing restraint of the slider from the above case.
Figure 8B:
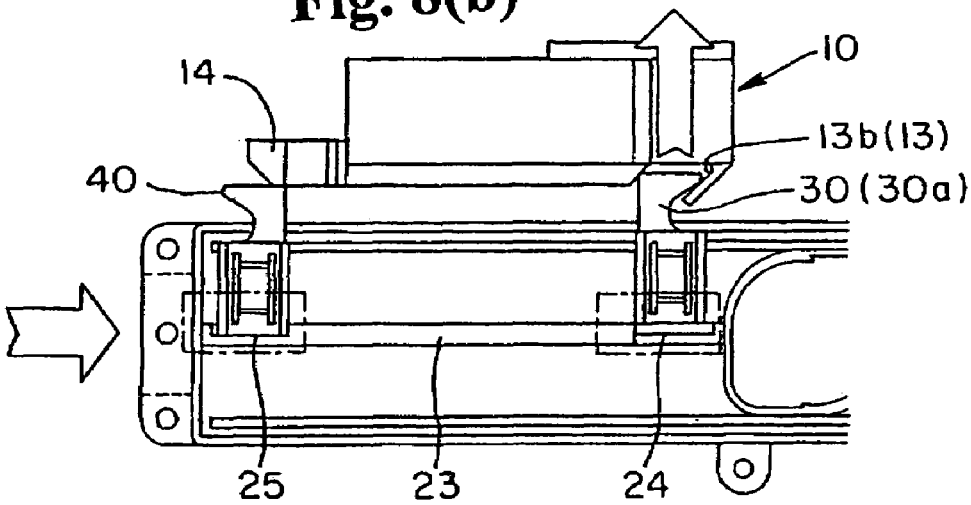
Figure 8C:
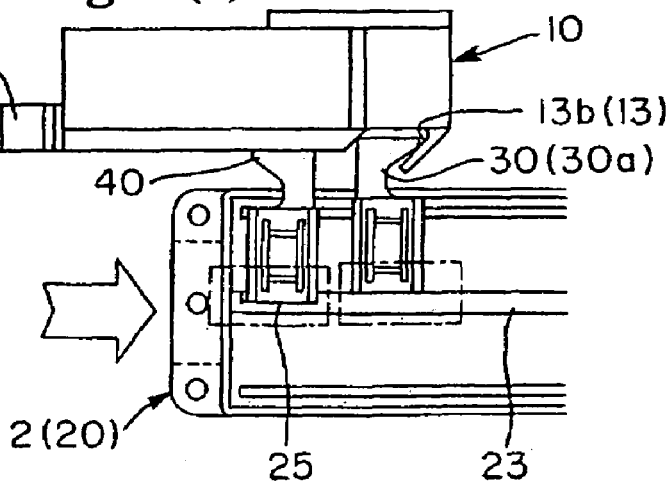
Figure 9A:
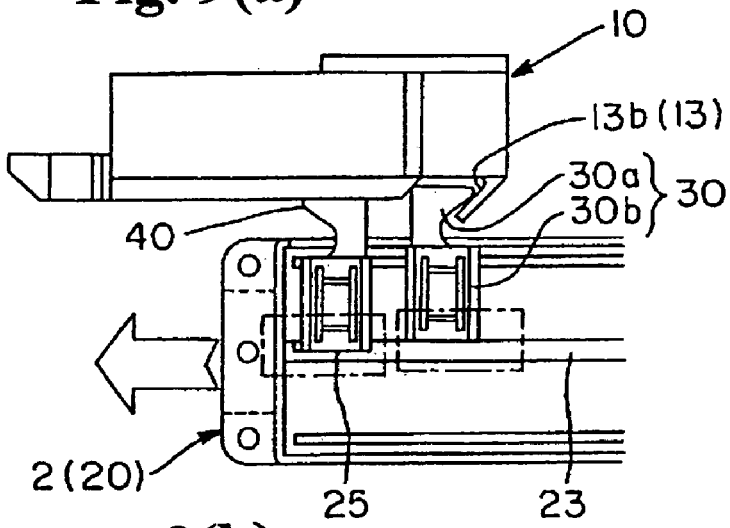
FIGS. 9(*a*), 9(*b*) and 9(*c*) are drawings showing operations which occur when restraining the above slider in position with respect to the case.
Figure 9B:
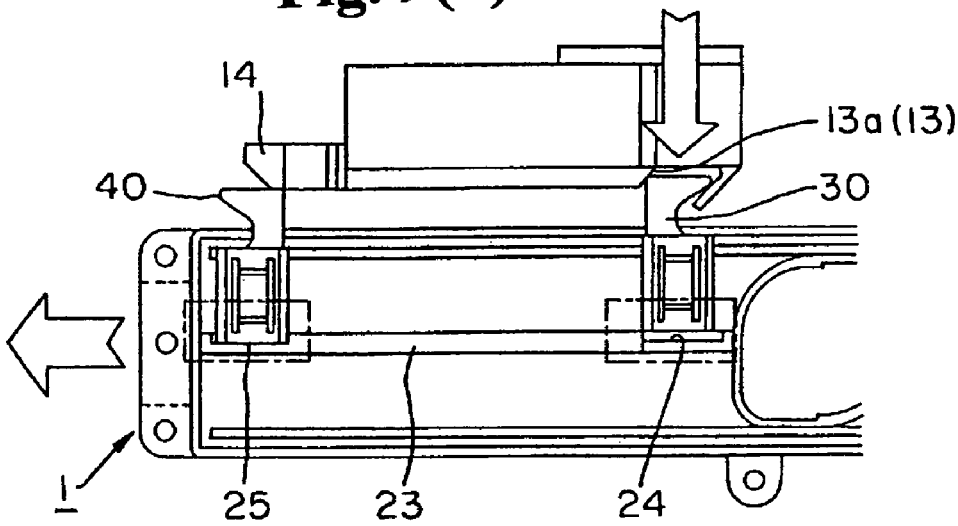
Figure 9C:
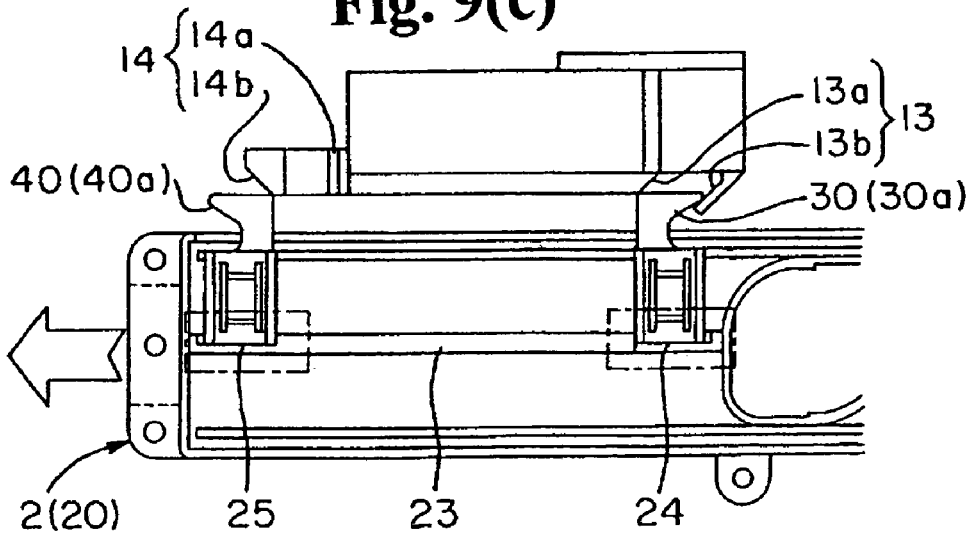
Figure 11A:
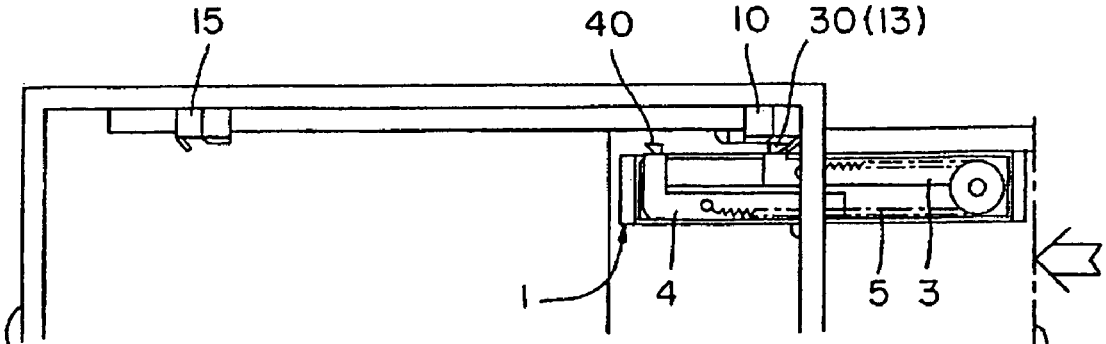
FIGS. 11(*a*), 11(*b*), 11(*c*) and 11(*d*) depict operations which occur during a drawing-in operation of the above sliding assisting apparatus just as in FIG. 10.
Figure 11B:
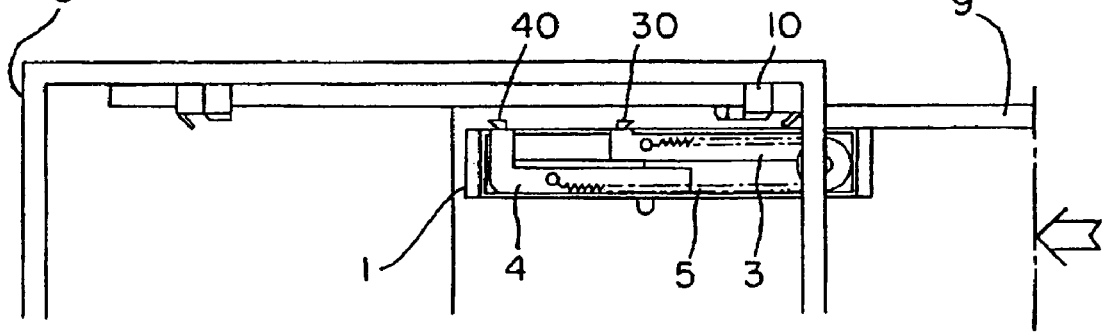
Figure 11C:
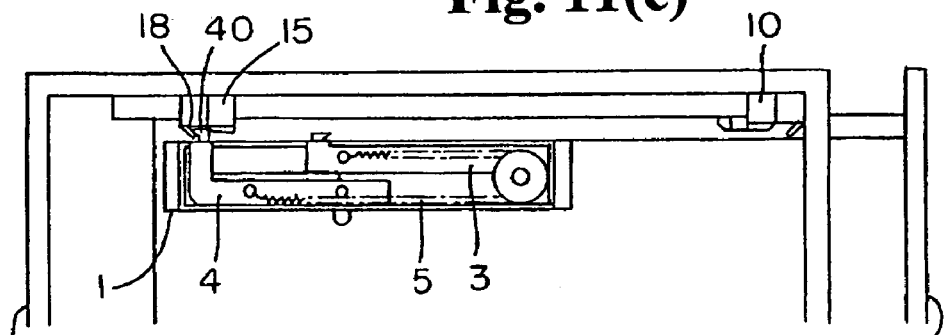
Figure 11D:
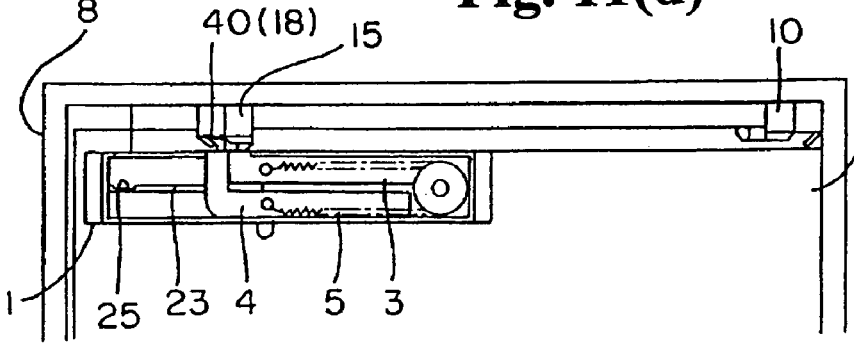
Figure 12A:
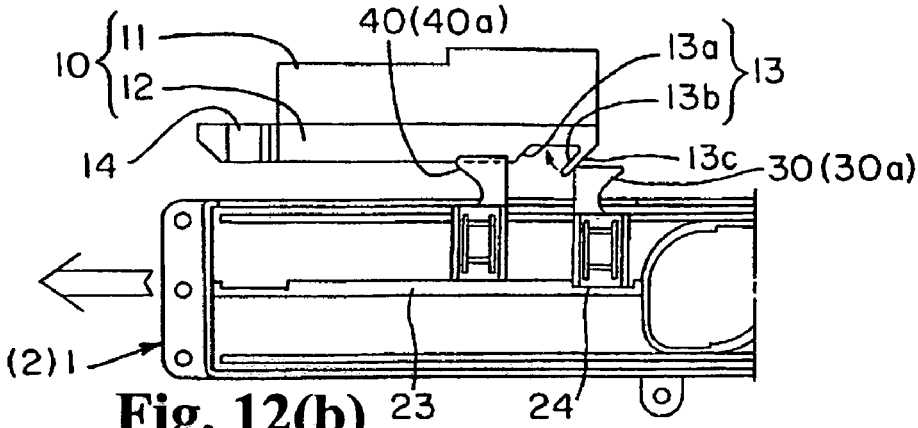
FIGS. 12(*a*), 12(*b*), 12(*c*) and 12(*d*) depict operations involved in establish a normal driving condition when assembling the movable body and the base.
Figure 12B:
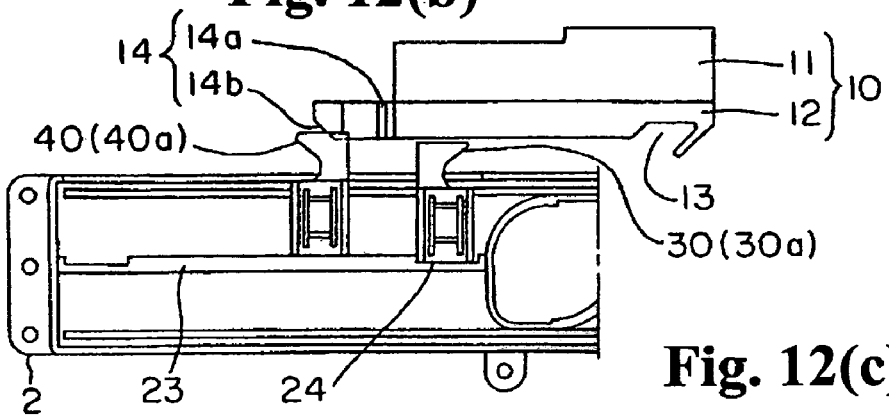
Figure 12C:
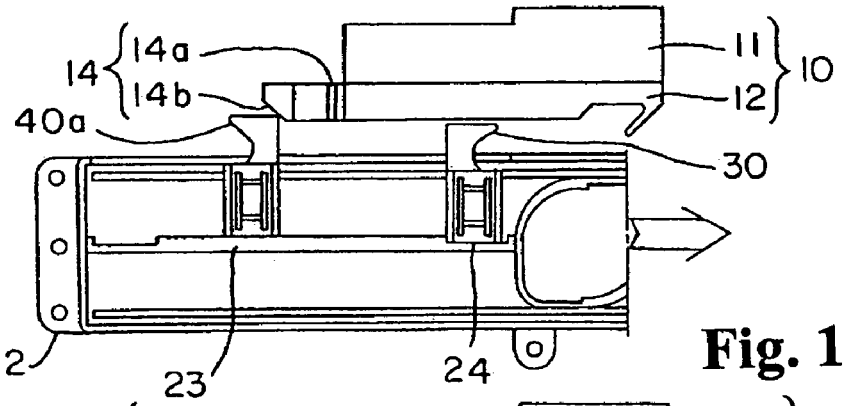
Figure 12D:
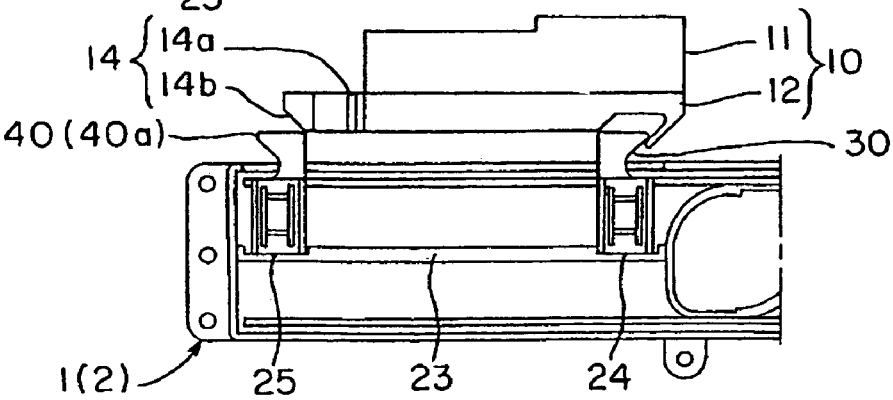

FIGS. 8(*a*), 8(*b*), FIG. 9(*a*) and FIG. 9(*b*) are explanatory views which depict the manner in which the sliders are restrained to the case and are then released. FIGS. 10(*a*)-10(*d*) and FIGS. 11(*a*)-11(*d*) are drawings showing the fundamental operations which occur when using the apparatus. FIGS. 12(*a*)-12(*d*) depict the assembling of a removable body onto the base. In these drawings, particularly FIG. 1, FIGS. 2(*a*), 2(*b*), and FIG. 8(*a*)-FIG. 13, non-essential parts are omitted in order to render the drawings more explicit and the operation easier to understand.

In the following description, after outlining an example of use of the sliding assisting apparatus, a detailed description of the apparatus structure and operations, is given.

Figure 15:
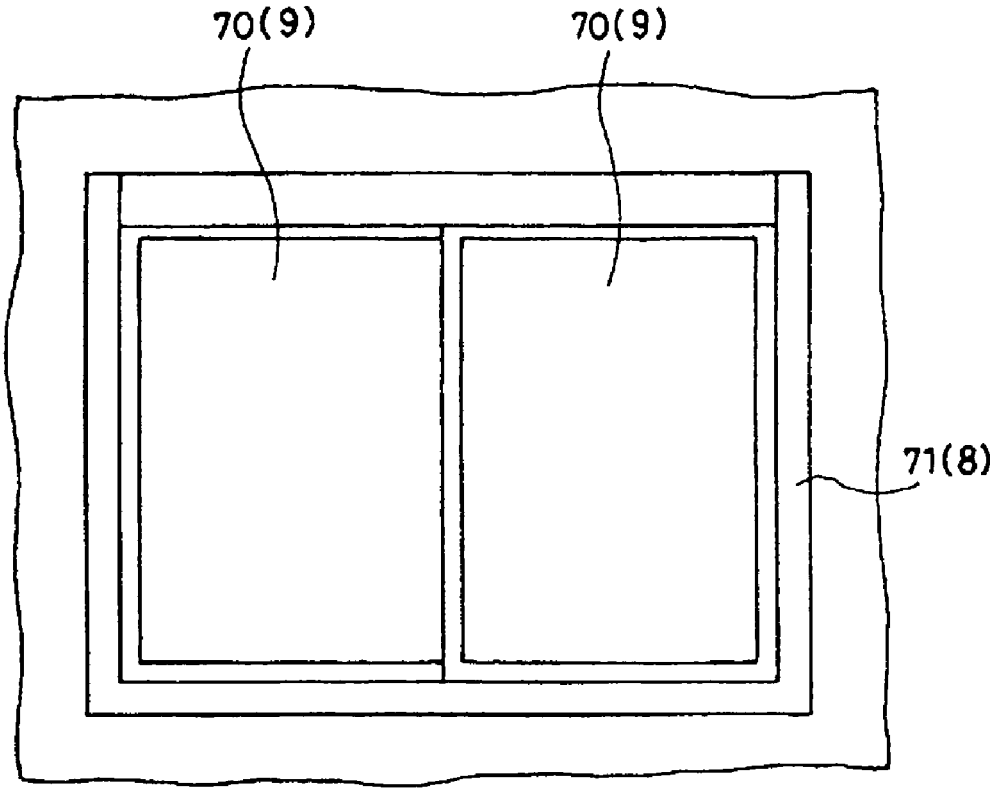
FIG. 15 shows a second working example in the form of a front view of a window.
Figure 16:
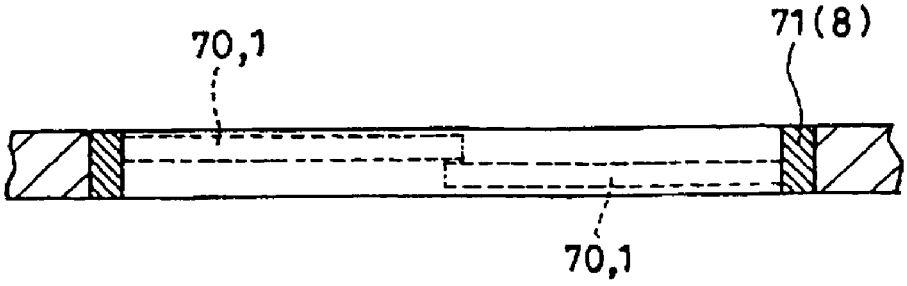
FIG. 16 is a sectional view of FIG. 15.
Figure 17:
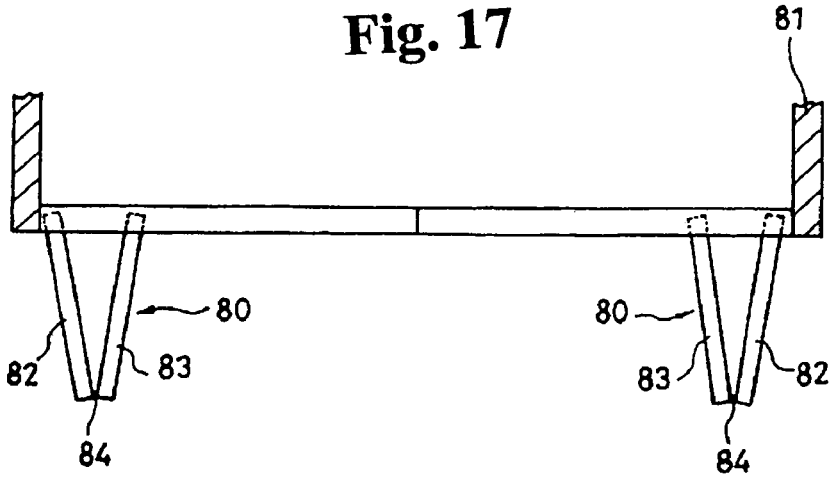
FIG. 17 shows a third working example in the form of a sectional view of a folding door.
Figure 18:
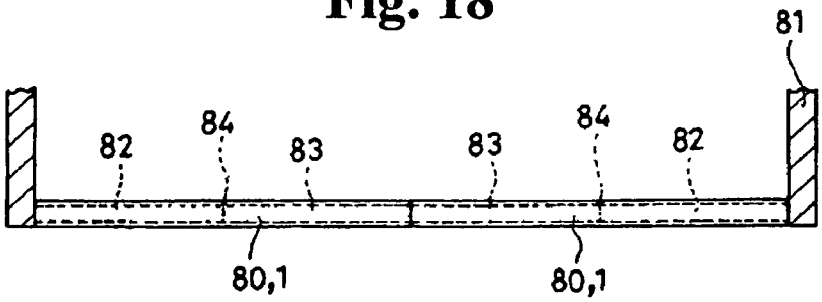
FIG. 18 is a sectional view showing the state in which the folding door in FIG. 17 is closed.
Figure 19:
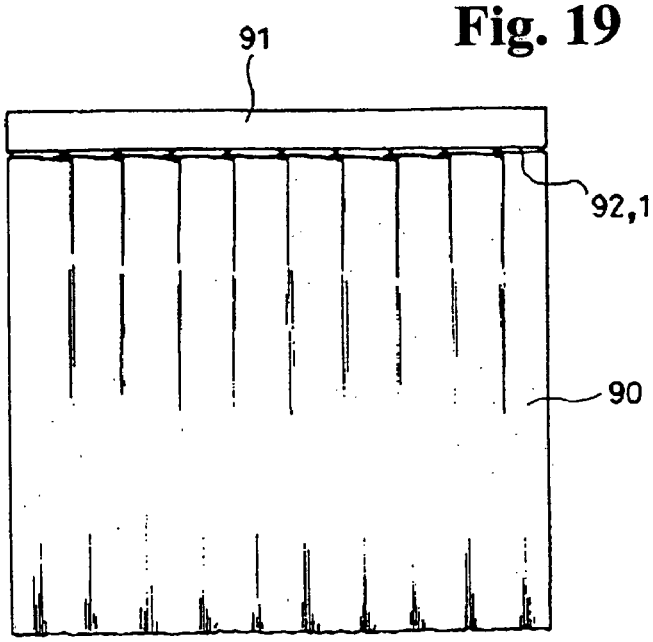
FIG. 19 shows a fourth working example in the form of a front view of a curtain.

FIG. 15-16 show a second working example, wherein FIG. 15 is a front view of a window, and FIG. 16 is a sectional view of the window shown in FIG. 15. FIGS. 17-18 show a third working example. In this instance, FIG. 17 shows a sectional view of a folding door, and FIG. 18 shows a sectional view in the state in which the folding door in FIG. 17 is closed; and FIG. 19 shows a fourth working example, in the form of a front view of a curtain.

The sliding assisting apparatus of the present invention is constituted as an assembly of a main body 1 and strikers 10, 15, and is configured to assist the operation of switching a movable body such as a tray or a lid to slide between a drawn-in position and a drawn-out position on a base on the side of a machine.

Figure 13:
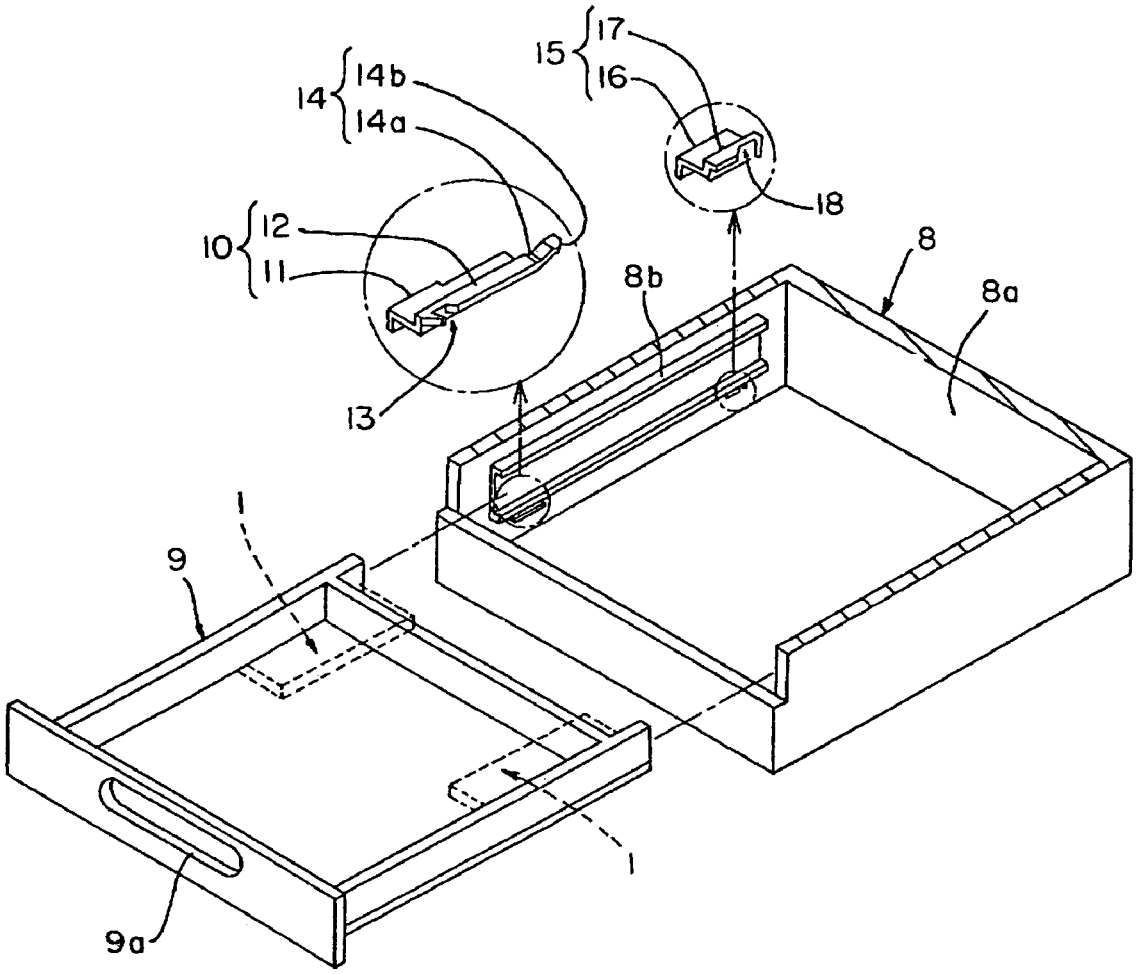
FIG. 13 is an exploded view showing the relationship between the movable body of an embodiment of the present invention and the base on the side of a machine.
Figure 14A:
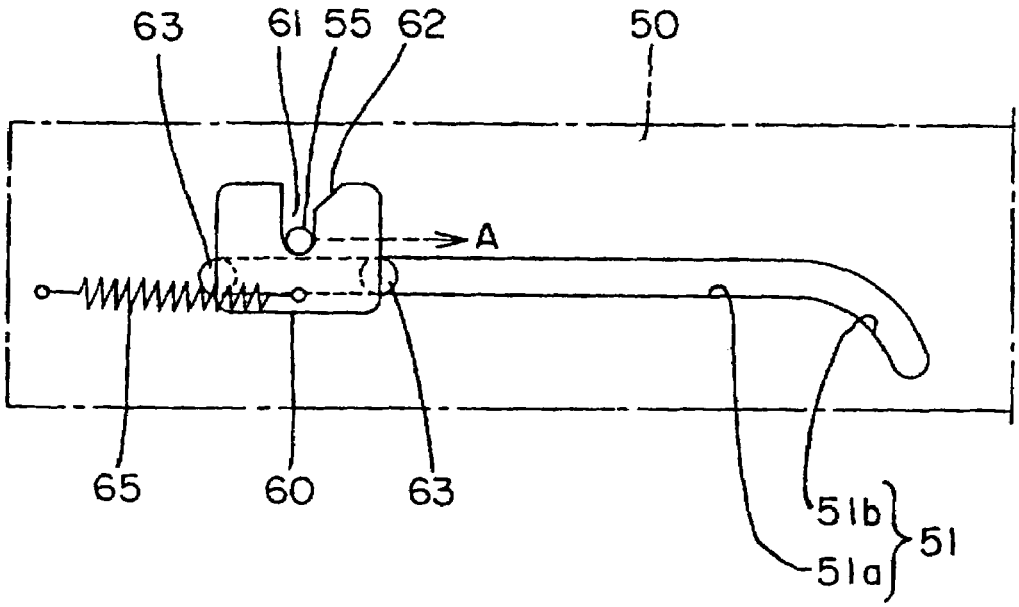
Fig. 14(a) Prior Art
FIGS. 14(*a*) and 14(*b*) are views depicting the structure and operation of a prior art arrangement.
Figure 14B:
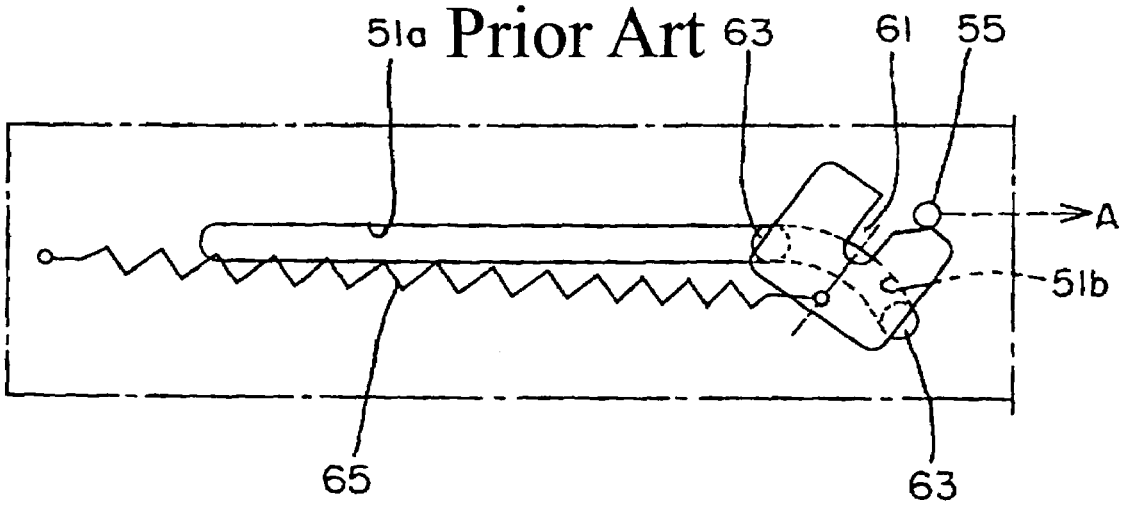
Fig. 14(b) Prior Art

FIG. 13 shows one specific example of a base and movable body. Numeral 8 denotes the base on the side of the machine. This base 8 is assumed to be the corresponding part of a photocopier or system kitchen, or the like, in which a space part or void 8*a* having the front face open is formed. Numeral 9 denotes the movable body corresponding to the space part 8*a*. The movable body 9 in this instance is a drawer member having a slit or opening 9*a*, or the like, for placing a finger, or the like, on the front wall, and it is slid forward and backward following a pair of guide rails 8*b* (only one shown) attached on the inside surfaces of the space part 8*a*. Also, in this embodiment, main bodies 1 are respectively attached on both sides at the rear on the bottom of the movable body 9, and in addition, strikers 10, 15 are attached on the sides of the guide rails 8*b* in correspondence with each main body 1.

However, in principle, it is possible also to attach the drawing-out/drawing-in unit 1 on the base 8, and to attach the strikers 10, 15 on the movable body 9. Although it is an example in which the number of groups used is two sets (two unit main bodies 1 and two pairs of strikers 10, 15), for example, there is no shortcoming even only one set is used if the movable body 9 is light and small. The structure between the base 8 and the movable body 9, is not limited to a guide rail 8*b*, and it is within the purview of the invention that another rail structure for guiding can be used.

In this embodiment, the unit main body 1 is comprised of two sliders 3, 4 which are disposed inside a case 2 and are capable of sliding respectively in the same direction as the movable body 9. A spring member 5 is interposed between the two sliders 3, 4 and is capable of accumulating force due to the movement of the sliders away from each other. This arrangement further includes damper 6 which damps the sliding speed of the movable body 9 via the sliders 3, 4, and lock members 30, 40 which are built into the respective sliders 3, 4 and which are capable being displaced in a direction roughly orthogonal to the sliding direction of the movable body 9. The detailed parts are as follows.

The case 2 consists of a case main body 20 and a cover 28 as in FIG. 3-FIG. 5, and has a rectangular container shape that is flat and long in the sliding direction of the movable body 9. Here, the case main body 20 partitions the inside with frame-like vertical walls 21, and also, one of the vertical walls which are opposite in the longitudinal direction is cut open from about the middle front to back up to the back end to form a step 22. This step 22 becomes a long groove which is open on the side of the case 2. On the inside bottom partitioned by the vertical walls 21, there are formed a guide rib 23 which is positioned in about the middle in the width direction and which extends from the back side (left side in FIG. 4) to about the middle front to back; support ribs 26*a*, 26*b* which are positioned near both sides and extend from the back side to a little before the front side (right side in FIG. 4); and a recessed part 27 for damper placement having a recessed shape which is positioned between the support ribs 26*a*, 26*b* at about the middle front to back. Coupling parts 24, 25 are provided on front and back parts of the guide rib 23. Each of the coupling parts 24, 25 has a recessed shape on the side of the guide rib 23 opposite the step 22.

A lock member 30 couples/uncouples with the coupling part 24, and a lock member 40 couples/uncouples with the coupling part 25. The recessed part 27 forms a damper receiving part, and the inner perimeter surface becomes a stepped part to enable the damper 6 (damper main body 6*a* thereof) described later, to rotate only in one direction. The shape of the recessed part 27, for example, also may be designed to a shape having rotated the one illustrated by about 90 degrees. The above case main body 20 is covered with a cover 28 after placing the sliders 3, 4 and the spring member 5 inside.

In this case, the cover 28 has a vertical wall 29 corresponding to the vertical wall 21 and a step 29*a* corresponding to the step 22, and it is integrated with the case main body 20 by a suitable coupling means, or the like. The above case 2, for example, also may have the case main body 20 and the cover 28 integrally formed by means of a thin hinge part.

Here, the damper 6 has at least a damper main body 6*a* which has plural teeth (alternatively these may take the form of protrusions) formed on the outer perimeter and is filled inside with operating oil. The damper 6 also has a gear 6*b* which is supported to rotate freely on the damper main body 6*a* by means of a shaft, or the like, and is subject to resistance of the operating oil, and for example, when it rotates clockwise, it idle rotates (the damper main body 6*a* idle rotates inside the recessed part 27), and when it rotates counterclockwise, the damper main body 6*a* becomes incapable of rotation due to the inner perimeter shape of the recessed part 27 and it damps the member on the other side (slider) by means of the gear 6*b*.

In other words, this structure cannot apply damping action when the damper main body 6*a* rotates, and it assumes a condition wherein it is capable of damping by means of the gear 6*b* when it is incapable of rotation. Also, the above damper 6, in relation to each slider 3 or 4 described later, is attached in a manner such that the gear 6*b* is disposed between racks 38, 48 of each slider 3 or 4, and in addition, it normally engages with one rack of the two racks 38, 48.

The respective sliders 3, 4 are disposed in parallel inside the case main body 20, and they assume a relationship wherein the two relatively approach and move away from each other (capable of movement in the vertical direction in the FIG. 1). Here, the slider 3 has a holding part 32 which is provided on one end side of a long piece part 31 and partitions a through-hole 32*a* which runs through in the width direction, a disk part 33 which is provided on the other end side, a groove-shaped spring placement part 34 and sliding ribs 36*a*, 36*b* which are provided in the longitudinal direction on the upper side of the long piece part 31. The slider also has an anchor shaft 35 which is provided inside the spring placement part 34, a pulley 37 for spring guidance attached to rotate freely on the disk part 33 by means of a shaft 33*a*, or the like, a rack 38 which is provided following a step formed in the longitudinal direction on the underside of the long piece part 31, a sliding rib 36*c* which is provided in the longitudinal direction on the underside of the long piece part 31, and the like.

The slider 3 is disposed inside the case main body 20 between the guide rib 23 and a vertical wall part of the vertical wall 21 on the side of the step 22, in a state in which the lock member 30 is inserted into the hole 32*a* and is supported to be capable of movement against the holding part 32, and it is slid freely for a sufficient distance between a forward position in which the holding part 32 is in contact with the front end surface of the step 22 as in FIG. 1 and FIG. 2(*a*), and a backward position in which it is in contact with the rear end surface of the step 22 with the holding part 43 of the slider 4 in between as in FIG. 2(*b*).

The lock member 30 includes a front end claw 30*a* which is disposed outside the holding part 32, and a base part 30*b* which is inserted into the hole 32*a*. The base part 30*b* is furnished with elasticity in the width direction by means of plural slits 30*c*, and it is inserted so as to be capable of being displaced against the hole 32*a*. Also, the above slider 3 is switched between a case restrained position in which the lock member 30 has entered deeply into the hole 32*a* and the rear end of the base part 30*b* is locked by the coupling part 24 of the guide rib 23 as in FIG. 1 and FIG. 2(*a*), and a case restraint released position in which the amount by which the lock member 30 protrudes from the hole 32*a* is increased and it is removed from the coupling part 24 as in FIG. 2(*b*).

As opposed to this, the slider 4 has a holding part 43 which is provided on one end side of a elongate part 41 with a thin plate-shaped bent part 42 in between and partitions a through-hole 43*a* which runs through in the width direction, a groove-shaped spring placement part 44 and sliding ribs 46*a*, 46*b* which are provided in the longitudinal direction on the upper side of the long piece part 41, a shaft 45 for anchoring which is provided inside the spring placement part 44, a rack 48 which is provided following a step formed in the longitudinal direction on the underside of the long piece part 41, a sliding rib 46*c* which is provided in the longitudinal direction on the underside of the long piece part 41, a guide groove 42*a* which is provided on the underside of the bent part 42 and continues with the corresponding inner surface of the hole 43*a*, and the like.

Also, the slider 4 is disposed inside the case main body 20 between the guide rib 23 and a corresponding vertical wall part of the vertical wall 21, in a state in which the lock member 40 is inserted into the hole 43*a* and is supported so as to be capable of movement against the holding part 43, and it is slid freely through a sufficient distance between a backward position in which the holding part 43 is in contact with the rear end surface of the step 22 as in FIG. 1 and FIG. 2(*b*), and a forward position in which it is in contact with the front end surface of the step 22 with the holding part 32 of the slider 3 in between as in FIG. 2(*a*). Also, the lock member 40 includes a front end claw 40*a* which is disposed outside the holding part 43, and a base part 40*b* which is inserted into the hole 43*a*. The base part 40*b* is furnished with elasticity in the width direction by means of plural slits 40*c*, and it is inserted to be capable of moving in displacement against the hole 43*a*. Also, the above slider 4 is switched between a case restrained position in which the lock member 40 has entered deeply into the hole 43*a* and the rear end of the base part 40*b* is locked by the coupling part 25 of the guide rib 23 as in FIG. 1 and FIG. 2(*b*), and a case restraint released position in which the amount by which the lock member 40 protrudes from the hole 43*a* is increased and it is removed from the coupling part 25 as in FIG. 2(*a*).

For the spring member 5, a coil-type spring member is used. One end is fixed to the shaft 35 on the side of the slider 3, the mid-course part is placed from the spring placement part 34 to the spring placement part 44 by way of the pulley 37, and the other end is fixed to the shaft 45 on the side of the slider 4. Also, the spring member 5 accumulates force when the two sliders 3, 4 are slid so as to move relatively away from each other as in FIG. 1, that force is held when both sliders 3, 4 are in the case restrained position, and the force is released when the sliders 3, 4 are slid so as to approach each other as in FIGS. 2(*a*) and 2(*b*). When the force is released, one of the sliders 3, 4 is switched to the case restrained position, and the other is switched to the case restraint released position. With a spring member 5 such as above, because the total length is long, a stabilized spring load can be obtained, and by interposing the pulley 37 between both sliders 3, 4, the friction during spring action can be eliminated, and also an efficient layout can be realized. Moreover, it becomes simpler and more advantageous in terms of cost than a constant-force spring or constant-pressure spring in which a spring plate wound around a spool is drawn out from a housing.

The striker 10 is a member that switches the lock member 30 on the slider 3 side between the case restrained position and the case restraint released position, and also controls so that the movable body 9 does not easily come out from the base 8 when it is drawn out in the case restraint released position of the slider 3 as in FIG. 2(*b*) and FIG. 10(*d*). In terms of shape, as shown in FIG. 1 and FIG. 13, it has an attachment part 11 to the side of the base 8, a guide part 12 which follows one side surface of the attachment part 11 and becomes one level higher, a first operation part 13 which is provided on the front side surface of the guide part 12, and a second operation part 14 which is provided extending toward the direction of the rear end of the guide part 12 and is capable of locking in the vertical direction. The first operation part 13 has a size capable of receiving the front end claw 30*a* of the lock member 30, and it has cam surfaces 13*a*, 13*b* placed oppositely front and back. The cam surface 13*a* is positioned on the rear side. The cam surface 13*b* is formed by the inner surface of an elastically deformable tongue piece part 13*c* which is protrudes from the guide part 12. The second operation part 14 is provided extending on the guide part 12 by means of a thin part 14*a*, and the front end side becomes slightly higher than the guide part 12. A tapered sloping part 14*b* which tapers in the forward direction, is provided on the front end. FIG. 8(*a*)-FIG. 11(*d*) show the striker 10 in the condition viewed from beneath, and FIGS. 12(*a*) and 12(*d*) shows the striker 10 in the condition viewed from above.

As opposed to this, the striker 15 is a member that switches the lock member 40 on the slider 4 side between the case restrained position and the case restraint released position, and also controls so that the movable body 9 does not enter too far into the space part 8*a* of the base 8 in the case restraint released position of the slider 4 as in FIG. 2(*a*) and FIG. 11(*d*). In terms of shape, as shown in FIG. 1 and FIG. 13, it has an attachment part 16 to the side of the base 8, a guide part 17 which follows one side surface of the attachment part 16 and becomes one level higher, and an operation part 18 which is provided on the outside surface of the guide part 17.

The operation part 18 has a size capable of receiving the front end claw 40*a* of the lock member 40, and it has cam surfaces 18*a*, 18*b* placed oppositely front and back. The cam surface 18*a* is positioned on the front side. The cam surface 18*b* is formed by the inner surface of an elastically deformable tongue piece part 18*c*, and it is placed protruding on the outside surface of the guide part 17. Although the apparatus of the present invention operates correctly even when the strikers 10, 15 have the same shape, that is, the shape of the striker 10 or the shape of the striker 15 described above, the operation 4 described later can be realized by making them custom parts as in this embodiment.

FIG. 1, FIGS. 2(*a*) and 2(*b*) show the state in which force is accumulated by the spring member 5 and the state in which it is released for sliding as fundamental operations of the above sliding assisting apparatus. Here, the two sliders 3, 4 in FIG. 1 are in the case restrained position in which each lock member 30 or 40 is locked by the corresponding coupling part 24 or 25, and the two are apart from each other to the maximum extent. In this state, the spring member 5 is accumulating force proportional to the distance between the two sliders 3, 4. FIGS. 2(*a*) and 2(*b*) show the state of the two in which that accumulated force is released. That is, FIG. 2(*a*) is the state in which the unit main body 1 (movable body 9) is moved toward the left side in FIG. 1 whereby the lock member 40 on the slider 4 side is unlocked from the coupling part 25 by operation of the striker 15, and it is automatically moved toward the left side by the force of the spring member 5. FIG. 2(*b*), on the other hand, shows the state in which the unit main body 1 (movable body 9) is moved toward the right side in FIG. 1 whereby the lock member 30 on the slider 3 side is unlocked from the coupling part 24 by operation of the striker 10, and it is automatically moved toward the right side by the force of the spring member 5. In this arrangement, the unit main body 1 (movable body 9) thus is automatically moved by the force of the spring member 5. In the course of moving, the unit main body 1 (movable body 9) is moved gently, being damped by the damper 6.

FIGS. 8(*a*), 8(*b*), 8(*c*) and FIGS. 9(*a*), 9(*b*), 9(*c*) show the movement when the above-described lock members are switched between locking and unlocking as fundamental operations of the sliding assisting apparatus.

FIGS. 8(*a*), 8(*b*) and 8(*c*) show the movement when the lock member 30 is unlocked, that is, when the slider 30 not illustrated is released from the case 2 (same as unit main body 1 or movable body 9). More specifically, FIG. 8(*a*) shows the state in which the case 2 is moved toward the right in FIG. 1, and the lock member 30 (front end claw 30*a* thereof) contacted with the cam surface 13*b* of the first operation part 13. FIG. 8(*b*) shows the state in which the unit main body 1 (movable body 9) is moved further toward the right, whereby that moving force is converted into a force pushing the lock member 30 upward, that is, the lock member 30 is pushed up by the stress on the front end claw 30*a* received from the cam surface 13*b*, and is unlocked from the coupling part 24. FIG. 8(*c*) shows the state in which by unlocking of the lock member 30 from the coupling part 24, the slider 3 became in the case restraint released position, and as a result, the case 2 (movable body 9) is moved forward against the striker 10 by the force of the spring member 5 accumulated up to then.

As opposed to this, FIGS. 9(*a*), 9(*b*), 9(*c*) show the movement when the lock member 30 is locked again, that is, when the slider 30 not illustrated is restrained to the case 2 (same as unit main body 1 or movable body 9). More specifically, FIG. 9(*a*) shows the state immediately before the case 2 is moved toward the left side from the state shown in FIG. 8(*c*). FIG. 9(*b*) shows the state in which the case 2 (movable body 9) is moved further toward the left while accumulating the force of the spring member 5, whereby that moving force is converted into a force pushing the lock member 30 downward, that is, the lock member 30 is about to be pushed down by the stress received from the cam surface 13*a*. FIG. 9(*c*) shows the state in which the case 2 (movable body 9) is moved further toward the left, whereby the lock member 30 is pushed down and locked by the coupling part 24 (the slider 3 not illustrated assuming in the case restrained position), and the force of the spring member 5 accumulated up to then is then stored or held. Although the above example is on the side of the lock member 30, the lock member 40 also is switched between FIG. 1 and FIG. 2(*a*) by the same kind of movement.

FIG. 10(*a*)-FIG. 11(*d*) show the operations when the movable body 9 is drawn out and drawn in from the space part 8*a* of the base 8 on the side of the machine as an example of use of the sliding assisting apparatus. In FIG. 10(*a*)-FIG. 11(*d*), numerals are assigned only to the main members, and reference should also be had to FIG. 1-FIG. 7(*c*) for further details with respect to associated elements.

FIG. 10(*a*) shows the state in the process of drawing outward in which the movable body 9 is being manually drawn out from the drawn-in position where it is housed inside the space part 8*a* on the base side illustrated in FIG. 11(*d*) and FIG. 2(*a*). In this process, the lock member 30 of one slider 3 of the sliders 3, 4 of the unit main body 1, is in the locked state, and the lock member 40 of the slider 4 is locked by the coupling part 25 while contacting the front end claw 40*a* to the cam surface 18*a* of the operation part 18 from the unlocked state in FIG. 2(*a*). That is, because the movable body 9 is drawn out while the damper 6 is idle rotated, and also because the slider 3 is in the case restrained position, the spring member 5 accumulates force increasingly accompanying the sliding of the movable body 9. Also, the accumulated force is held just as in FIG. 1 when the lock member 40 is switched to the locked state.

FIG. 10(*b*) shows the state in which the movable body 9 is being further drawn outward in the state in which the force thus accumulated is held (that is, the spring member 5 is neutral).

FIG. 10(*c*) shows the state in which the movable body 9 is further drawn out and immediately after the lock member 30 of the slider 3 is switched to unlocked state by the striker 10. In this process, similar to FIG. 8, the lock member 30 contacts the front end claw 30*a* to the cam surface 13*b* of the first operation part 13 of the striker 10, and it is pushed up by means of the front end claw 30*a* by the recoil or cam action received from that cam surface 13*b*, and as a result, it is unlocked from the coupling part 24.

FIG. 10(*d*) is the state in which by unlocking of the lock member 30 thus, that is, by switching of the slider 3 to the case restraint released position, the movable body 9 is slid automatically up to the final drawn-out position by the force of the spring member 5 just as in FIG. 2(*b*). In this structure, while going from FIGS. 10(*c*)-10(*d*), the damper 6 damps the sliding speed of the movable body 9 via the engagement between the rack 48 of the slider 4 and the gear 6*b*. As a result, the movable body 9 is slid at a gentle speed from the mid-course position up to the final drawn-out position.

FIG. 11(*a*) shows the state wherein the movable body 9 is operated to be drawn inward from the drawn-out position in FIG. 10(*d*) to the mid-course position. In this process of drawing inward, because the lock member 40 is in the locked position (the slider 4 is in the case restrained position) and the lock member 30 is in the unlocked position (the slider 3 is in the case restraint released position), the spring member 5 increasingly accumulates force as the sliding of the movable body 9 continues. Also, when the lock member 30 is located opposite the coupling part 24 as in FIGS. 9(*b*), 9(*c*), it is pushed down by the stress on the front end claw 30*a* received from the cam surface 13*a* of the first operation part 13 and is locked by the coupling part 24 (the slider 3 becomes in the case restrained position), and the accumulated force of the spring member 5 is held.

FIG. 11(*b*) shows the state in which the movable body 9 is being further drawn inward in a state in which the force thus accumulated is held (that is, the spring member 5 is neutral).

FIG. 11(*c*) shows the state in which the movable body 9 is operated to be drawn inward up to the mid-course position and immediately before the lock member 40 of the slider 4 is switched to unlocked by the operation part 18 of the striker 15. That is, in this process of drawing inward, the front end claw 40*a* of the lock member 40 contacts the cam surface 18*b* of the operation part 18 as shown on the left side in FIG. 1, and the lock member 40 is pushed upward by the cam action provided by the cam surface 18*b*, whereby it is unlocked from the coupling part 25.

FIG. 11(*d*) shows the state in which the movable body 9 is slid automatically up to the final drawn-in position by the force of the spring member 5 by switching of the lock member 40 to unlocked (the slider 4 assumes the case restraint released position). In this arrangement, while going from 11(*c*)-11(*d*), the damper 6 damps the sliding speed of the movable body 9 via the engagement between the rack 48 and the gear 6*b*. As a result, the movable body 9 is induced to slide at a gentle speed from the mid-course position up to the final drawn-in position.

In the above sliding assisting apparatus, the movable body 9 may be removed from the space part 8*a* of the base 8 on the machine side in order to perform cleaning or maintenance, or the like, and it is designed so that in the event that it is removed and is set again in the space part 8*a* of the base, it can be assuredly restored to a normal operative position even if the lock members hit something and move. The movable body 9 is configured to become removable from the space part 8*a*, from the state in FIG. 2(*b*) and FIG. 10(*d*) which is the drawn-out position (the slider 3 is in the case restraint released position, and the slider 4 is in the case restrained position), for example, by lifting up or tilting the movable body 9, such that the front end claw 30*a* of the lock member 30 comes out of the first operation part 13 of the striker 10. Also, if the movable body 9 is in the same state as when it is removed from the base 8, it is set in the space part 8*a* by performing the reverse operation used to remove it.

In the above unit main body 1, it also may occur that the lock member 40 is unlocked from the coupling part 25 such as by a load produced via contact with the lock member 40, or the lock member 30 is unlocked from the coupling part 24, assumed when the movable body 9 is removed from the base 8. FIG. 12 depicts such a situation (when the slider 4 not illustrated assumes the case restraint released position), and depicts how the movable body 9 (not illustrated) is set in the base 8 and also is restored to normal a normal operating condition.

FIG. 12(*a*) is an exemplary illustration of the condition wherein the movable body 9 is inserted into the space part 8*a* on the base side. Here, in the unit main body 1, because the lock member 40 is unlocked, it is free to slide forward together with the slider 4, and the lock member 30 is slid freely in the same direction by the sliding. Therefore, in this structure, first, in the initial process in which the movable body 9 is inserted into the space part 8*a* on the base side, the front end claw 40*a* of the lock member 40 is slid following the top surface of the guide part 12 of the striker 10 due to the difference of height, and in addition, the front end claw 30*a* of the lock member 30 hits the tongue piece part 13*c* and is pressed down. As a result, the lock member 30 is locked by the coupling part 24 (the slider 3 assumes the case restrained position) as in the same drawing, and the front end claw 30*a* rides past while elastically deforming the tongue piece part 13*c* in a collapsing direction. Also, in this structure, when the movable body 9 is further drawn in, the lock member 40 (front end claw 40*a* thereof) rides past the second operation part 14 while bending it downward via the thin part 14*a* as in FIG. 12(*b*).

In accordance with this, the lock member 40 contacts the front end sloping surface 14*b* of the second operation part 14 on the upper hook part of the front end claw 40*a* with an accompanying clicking sound as in FIG. 12(*c*). By forward drawing-out of the unit main body 1 (movable body 9) as in FIG. 12(*c*) from that state, the lock member 40 assumes a condition of having been slid relatively backward (at this time, the spring member 5 not illustrated accumulates force), and finally it is locked with the coupling part 25 as in FIG. 12(*d*). As a result, it is restored to normal driving just as in FIG. 1 and FIG. 10(*b*) as well as FIG. 11(*b*). Thus, as above, with this structure, the reliability can be improved because it can always be restored to normal driving (operation) even when the movable body 9 is removed from the base 8 on the machine side and furthermore is in a state different from when it is removed due to the lock member being subject to an external load.

The present invention is not limited whatsoever to the above embodiments, and is limited only by the appended claims. The various modifications which are possible without departing from the scope of the appended claims will be self-evident to the those skilled in the art to which this invention pertains or those skilled in a closely related art given the preceding disclosure. The apparatus of the present invention therefore has no particular limitation in terms of use, for example, if the movable body is a lid body, the drawn-in position becomes the closed position in which it is disposed on a prescribed place on the base, and the drawn-out position becomes the open position in which it is moved away from the prescribed place on the base.

Although it is possible to simplify the damper 6 by making it such that the rotational direction is restricted by setting of the shape of the damper main body 6*a* on the recessed part 27 so that it damps only when rotating in one direction, there is no restriction on this and this feature can be changed without deviating from the scope of the claims. Also, the spring member 5 also may comprise a resilient structure such as a constant-pressure spring.

Of course, the "pair of strikers can be alternatively termed operation members, or the like. Also, as a structure, an arrangement in which the first operation part 13 (and second operation part 14 according to need) of the striker 10 and the operation part 18 of the striker 15 respectively are formed on a single long and thin member is also included within the scope of the invention.

Next, uses of the sliding assisting apparatus are explained.

First, as examples of front-back sliding type which slides in the front-back direction, such as a drawer 9, there are those such as the following.

(1) Drawer or Drawer Type Sliding Table of Furniture

The base 8, although not illustrated, may be a storage part of furniture, and at this time, the movable body 9 can be a drawer or sliding table attached in the storage part to be capable of being moved in and out of a storage position.

(2) Drawer or Drawer Type Sliding Table of System Kitchen

Furniture, although not illustrated, may be a system kitchen, and at this time, the movable body 9 becomes a drawer or sliding table attached to the storage part of the system kitchen to be capable of being moved in and out.

(3) Drawer, Drawer Type Sliding Table, Keyboard Table of PC Desk

The furniture, although not illustrated, may be a PC desk, and at this time, the movable body 9 becomes a drawer, sliding table or keyboard table attached to the PC desk to be capable of drawing out (being moved out of a storage position).

(4) Drawer, Drawer Type Sliding Table of Chest of Drawers

The furniture, although not illustrated, may be a chest of drawers, and at this time, the movable body 9 becomes a drawer or sliding table attached to the chest of drawers to be capable of drawing out.

(5) Drawer of Home Electric Appliance

The base 8, although not illustrated, may be a storage part of a home electric appliance, and at this time, the movable body 9 becomes a drawer attached in the storage part to be capable of drawing out.

(6) Drawer or Refrigerator

The home electric appliance, although not illustrated, may be a refrigerator, and at this time, the movable body 9 becomes a drawer of the refrigerator.

Refrigerator is Used Generically and Should be Understood to Include a Freezer.

(7) Drawer of Middle Case of Refrigerator (Including Freezer)

The movable body 9, although not illustrated, may be a drawer of a middle case inside a refrigerator.

(8) Paper Feed Tray of Information Appliance (for Example Copy Machine, Fax Machine, Copy Machine, Combined Machine)

The home electric appliance, although not illustrated, may be an information appliance for example such as a copy machine, fax machine, copy machine or combined machine, and at this time, the movable body 9 becomes a paper feed tray.

(9) Drawer of Office Desk

The base 8, although not illustrated, may be an office desk, and at this time, the movable body 9 becomes a drawer of the office desk.

(10) Drawer of Cabinet

The base 8, although not illustrated, may be an office cabinet, and at this time, the movable body 9 becomes a drawer of the cabinet.

(11) Drawer Type Ashtray of Automobile

The base 8, although not illustrated, may be a storage part of an ashtray in a car, and at this time, the movable body 9 becomes a drawer type ashtray attached in the storage part to be capable of drawing out.

(12) Drawer Type Cup Holder of Automobile

The base 8, although not illustrated, may be a storage part of an ashtray and/or cup holder in a car, and at this time, the movable body 9 becomes a drawer type cup holder attached in the storage part to be capable of drawing out.

(13) Drawer Type Console Lid of Automobile

The base 8, although not illustrated, may be a console for example such as a center console in a car, and at this time, the movable body 9 becomes a drawer type console lid attached to the console to be capable of drawing out.

(14) Drawer of Cash Register

The base 8, although not illustrated, may be a cash register, and at this time, the movable body 9 becomes a drawer of the cash register.

(15) Other

Drawer or drawer type sliding table of furniture

Drawer or drawer type sliding table of cupboard

Drawer, drawer type sliding table, drawer type keyboard table of various kinds of desks such as writing desk, school desk, PC desk Drawer type water supply tank of refrigerator (freezer)

Drawer type ice machine or ice chest of refrigerator (freezer)

Window 70-FIGS. 15-16

Next, a window 70 as one example of a movable body 9 is explained using FIGS. 15-16.

Left and right windows 70 are supported to be drawn contrarily on a window frame 71 as the base 8.

Unit main bodies 1 are attached respectively on the left and right windows 70.

That is, a unit main body 1 is fixed on at least either one of the upper and lower surfaces of each window 70.

As opposed to this, although not illustrated, the strikers 10, 15 which couple with the lock members 30, 40 of the unit main body 1 are fixed on the upper or lower frame of the window frame 71.

When the left or right window 70 is closed, one of the lock members 30, 40 couples with one of the strikers 10, 15 in mid-course, whereby the left or right window 70 is assuredly closed by the spring returning force accumulated in the spring member 4.

As opposed to this, when the left or right window 70 is opened, the other of the lock members 30, 40 couples with the other of the strikers 10, 15 in mid-course, whereby the left or right window 70 is assuredly opened by the spring returning force accumulated in the spring member 4.

Next, a folding door 80 as one example of a movable body 9 is explained using FIGS. 17-18.

Both ends left and right of left and right folding doors 80 are supported to be capable of sliding in the left-right direction on a closet 81 as the base 8.

Each folding door 80 is constituted by two doors as an outside door 82 and a center door 83, and the outside door 82 and the center door 83 are folded up in a V shape by means of a hinge 84.

Although not illustrated, slide rails are fixed on the top and bottom of the closet 81, and the ends on the sides that are apart left and right of the outside door 82 and the center door 83 respectively are supported to be capable of sliding on the upper and lower slide rails.

Unit main bodies 1 are attached respectively on the left and right folding doors 80.

That is, a unit main body 1 is fixed on at least either one of the upper and lower surfaces of each folding door 80.

As opposed to this, although not illustrated, the strikers 10, 15 which couple with the lock members 30, 40 of the unit main body 1 are fixed on the upper or lower frame of the closet 81.

When the left or right folding door 80 is closed, one of the lock members 30, 40 couples with one of the strikers 10, 15 in mid-course, whereby the left or right folding door 80 is assuredly closed by the spring returning force accumulated in the spring member 4.

As opposed to this, when the left or right folding door 80 is opened, the other of the lock members 30, 40 couples with the other of the strikers 10, 15 in mid-course, whereby the left or right folding door 80 is assuredly opened by the spring returning force accumulated in the spring member 4.

Curtain 90 in FIG. 19

Next, a curtain 90 as one example of a movable body 9 is explained using FIG. 19.

A curtain rail 92 as the base 8 is fixed on the upper frame 91.

Also, although not illustrated, a curtain 90 is hung on the curtain rail 92 by means of a curtain runner.

The unit main body 1 is attached to the curtain 90 using the runner.

As opposed to this, although not illustrated, the strikers 10, 15 which couple with the lock members 30, 40 of the unit main body 1 are fixed on the upper frame.

When the curtain 90 is closed, one of the lock member 30, 40 couples with one of the strikers 10, 15 in mid-course, whereby the curtain 90 is assuredly closed by the spring returning force accumulated in the spring member 4.

As opposed to this, when the curtain 90 is opened, the other of the lock members 30, 40 couples with the other of the strikers 10, 15 in mid-course, whereby the curtain 90 is assuredly opened by the spring returning force accumulated in the spring member 4.

Examples of Left-Right Sliding Type

As examples of left-right sliding type which slides in the left-right direction, such as a window 70, folding door 80 or curtain 90, there are those such as the following (1) Storm Door The movable body 9, although not illustrated, may be a storm door of a building.

(2) Shutter

The movable body 9, although not illustrated, may be a shutter of a building.

(3) Sliding Door

The movable body 9, although not illustrated, may be a sliding door (indoor or outdoor) of a building.

(4) Bathroom Door

The movable body 9, although not illustrated, may be a bathroom door.

(5) Movable Type Space Partition

The movable body 9, although not illustrated, may be a movable type space partition.

(6) Sliding Door of Middle Case of Refrigerator

The movable body 9, although not illustrated, may be a sliding door of a middle case of a refrigerator.

Refrigerator is used as a concept to include freezer.

(7) Moving Rack

The movable body 9 may be a moving rack that slides left and right.

(8) Sliding Door of Automobile

The movable body 9, although not illustrated, may be a sliding door of an automobile.

(9) Sliding Door of Display Refrigerator

The movable body 9, although not illustrated, may be a sliding door of a display refrigerator.

Display refrigerator is used as a concept to include freezer.

(10) Other

Sliding type opening-and-closing door of cupboard

Sliding type opening-and-closing door of clog cabinet

Sliding type opening-and-closing door of bookshelf

Sliding type door of vehicle such as electric train/trolley, (steam) train, ship, airplane, or the like Examples of Vertical Sliding Arrangements The movable body 9, although not illustrated, is not limited to left-right moving members, and the movable body 9 can also be slid up and down in the vertical direction, with one sliding position as an ascended position and the other sliding position as a descended position.

As examples of up-down sliding type which slides in the up-down direction, there are those such as the following.

(1) Ascending-Descending Type Shutter

The movable body 9, although not illustrated, may be an ascending-descending type shutter of a building.

(2) Ascending-Descending Type Window

The movable body 9, although not illustrated, may be an ascending-descending type window of a building.

(3) Ascending-Descending Type Blinds

The movable body 9, although not illustrated, may be ascending-descending type blinds.

(4) Ascending-Descending Type Moving Rack

The movable body 9, although not illustrated, may be an ascending-descending type movable rack.

The disclosure of Japanese Patent Application No. 2004-213627 filed on Jul. 21, 2004 is incorporated herein.

While the invention has been explained with reference to the specific embodiments of the invention, the explanation is illustrative and the invention is limited only by the appended claims.

What is claimed is:

1. A combination comprising a movable body and a sliding assisting apparatus assisting sliding of the movable body on a base in one direction from one sliding position to a second sliding position, and in a second direction from the second sliding position to the first sliding position, wherein the sliding assisting apparatus comprises:

a main body provided on one of the base and the movable body, and having a case, and a pair of sliders disposed in the case, each of the pair of sliders being respectively capable of sliding in a direction in which the movable body is moving;

lock members respectively disposed with and arranged to be displaceable along one of the sliders and having front ends protruding out of the case;

coupling parts provided on the case and couple/uncouple with the lock members of the respective sliders with the case;

forcing means provided between the two sliders and arranged to accumulate a biasing force when one of the sliders is slid in a direction away from the other slider;

a pair of strikers provided on the other of the base and the movable body, and a switch between a case restrained position in which the lock members of the sliders are locked by the coupling parts to restrain the concerned sliders to the case, and a case restraint released position in which the locking is released to enable sliding of the concerned sliders on the case;

wherein one striker of the pair of strikers is disposed between the first and second sliding positions to cause the movable body to slide toward the first sliding position; and a second striker of the pair of strikers is disposed in a position closer to the second sliding position than the first striker, and configured to cause the movable body to slide toward the second sliding position.

2. A combination as recited in claim 1, wherein the movable body slides in a front-back direction; the first sliding position is a drawn-in position; and the second sliding position is a drawn-out position.

3. A combination as recited in claim 2, wherein the base is a storage part of a furniture; and the movable body is a drawer which is attached in the storage part to be capable of drawing out.

4. A combination as recited in claim 1, wherein the movable body slides in a left-right direction; the first sliding position is an open position; and the second sliding position is a closed position.

5. A combination as recited in claim 1, wherein the movable body slides in a vertical direction; the first sliding position is an ascended position; and the second sliding position is a descended position.

6. A combination as recited in claim 1, wherein said sliding assisting apparatus further comprises a damping device operatively connected with at least one of the sliders so as to damp a sliding speed of the at least one slider with respect to the case in which it is disposed.

7. A combination as recited in claim 6, wherein the damper device comprises at least one rotatable member immersed in a viscous liquid.

8. A combination as recited in claim 1, wherein the forcing means comprises a spring, and the sliding assisting apparatus further comprises a rotatable pulley disposed in the case about which the spring extends.

9. A sliding assisting apparatus for assisting sliding of a movable body on a base in one direction from one sliding position to a second sliding position, and in a second direction from the second sliding position to the first sliding position, comprising:

a main body adapted to be provided on one of the base and the movable body, and having a case, and a pair of sliders disposed in the case, each of the pair of sliders being respectively capable of sliding in a direction in which the movable body is moving;

lock members respectively disposed with and arranged to be displaceable along one of the sliders and having front ends protruding out of the case;

coupling parts provided on the case and couple/uncouple with the lock members of the respective sliders with the case;

forcing means provided between the two sliders and arranged to accumulate a biasing force when one of the sliders is slid in a direction away from the other slider;

a pair of strikers adapted to be provided on the other of the base and the movable body, and a switch between a case restrained position in which the lock members of the sliders are locked by the coupling parts to restrain the concerned sliders to the case, and a case restraint released position in which the locking is released to enable sliding of the concerned sliders on the case;

wherein one striker of the pair of strikers is adapted to be disposed between the first and second sliding positions to cause the movable body to slide toward the first sliding position; and a second striker of the pair of strikers is adapted to be disposed in a position closer to the second sliding position than the first striker, and configured to cause the movable body to slide toward the second sliding position.

10. A sliding assisting apparatus as recited in claim 9, further comprising a damping device operatively connected with at least one of the sliders so as to damp a sliding speed of the at least one slider with respect to the case in which it is disposed.

11. A sliding assisting apparatus as recited in claim 10, wherein the damper device comprises at least one rotatable member immersed in a viscous liquid.

12. A sliding assisting apparatus as recited in claim 9, wherein the forcing means comprises a spring, and the sliding assisting apparatus further comprises a rotatable pulley disposed in the case about which the spring extends.

* * * * *